US006491115B2

(12) United States Patent
Van Houwelingen et al.

(10) Patent No.: US 6,491,115 B2
(45) Date of Patent: Dec. 10, 2002

(54) DIRECTIONAL DRILLING MACHINE AND METHOD OF DIRECTIONAL DRILLING

(75) Inventors: Mark Van Houwelingen, Knoxville, IA (US); Randy Runquist, Oskaloosa, IA (US); Brian J. Bischel, Hartland, WI (US); Mark R. Stelter, Pella, IA (US); Gregg A. Austin, Pella, IA (US)

(73) Assignee: Vermeer Manufacturing Company, Pella, IA (US)

( * ) Notice: Subject to any disclaimer, the term of this patent is extended or adjusted under 35 U.S.C. 154(b) by 31 days.

(21) Appl. No.: 09/767,107

(22) Filed: Jan. 22, 2001

(65) Prior Publication Data

US 2001/0022238 A1 Sep. 20, 2001

Related U.S. Application Data

(63) Continuation-in-part of application No. 09/525,408, filed on Mar. 15, 2000, now Pat. No. 6,357,537.

(51) Int. Cl.[7] ..... E21B 44/00
(52) U.S. Cl. ..... 175/27; 175/57
(58) Field of Search ..... 175/24, 27, 19, 175/26, 40, 45, 48, 61, 57; 340/853.2, 853.3, 853.4, 853.5, 853.6; 173/28, 46, 152

(56) References Cited

U.S. PATENT DOCUMENTS

| | | | | |
|---|---|---|---|---|
| 2,271,005 | A | 1/1942 | Grebe | |
| 2,300,016 | A | 10/1942 | Scott et al. | 255/1.6 |
| 2,324,102 | A | 7/1943 | Miller et al. | 255/1.6 |
| 2,783,972 | A | 3/1957 | Fehlmann | 255/24 |
| 3,525,405 | A | 8/1970 | Coyne et al. | 175/19 |
| 3,529,682 | A | 9/1970 | Coyne et al. | 175/45 |
| 3,536,151 | A | 10/1970 | Aarup | 175/422 |
| 3,878,903 | A | 4/1975 | Cherrington | 175/45 |
| 4,144,941 | A | 3/1979 | Ritter | 175/19 |
| 4,262,758 | A | 4/1981 | Evans | 175/73 |
| 4,384,483 | A | 5/1983 | Dellinger et al. | |
| 4,396,073 | A | 8/1983 | Reichman et al. | 175/74 |
| 4,416,339 | A | 11/1983 | Baker et al. | 175/61 |
| 4,453,603 | A | 6/1984 | Voss et al. | 175/53 |

(List continued on next page.)

FOREIGN PATENT DOCUMENTS

| | | |
|---|---|---|
| EP | 0 209 217 B2 | 1/1987 |
| EP | 0 467 642 A2 | 1/1992 |
| EP | 0 816 627 A3 | 4/2000 |
| JP | 56-64090 | 6/1981 |
| WO | WO 93/12319 | 6/1993 |
| WO | WO 97/33065 | 9/1997 |
| WO | WO 01/51760 A2 | 7/2001 |

*Primary Examiner*—Robert E. Pezzuto
(74) *Attorney, Agent, or Firm*—Crawford PLLC

(57) ABSTRACT

A system, apparatus and method for automatically limiting the thrust force applied to a drill string during an underground boring process, in order to prevent the deformation or collapse to the drill rods due to reaching the yield point of the rods. One or more drill string characteristics that have an impact on the yield point of the drill string, or portions of the drill string, are determined. The yield point of the drill string or portion is computed, where the yield point is computed as a function of the drill string characteristics. The thrust force imparted to the drill string is adjusted in response to the computed yield point.

54 Claims, 23 Drawing Sheets

U.S. PATENT DOCUMENTS 4,632,191 A 12/1986 McDonald et al. ..... 175/19
4,637,479 A 1/1987 Leising ..... 175/26
4,658,916 A 4/1987 Bond
4,674,579 A 6/1987 Geller et al. ..... 175/45
4,679,637 A 7/1987 Cherrington et al. ..... 175/61
4,694,913 A 9/1987 McDonald et al. ..... 175/61
4,714,118 A 12/1987 Baker et al. ..... 175/26
4,787,463 A 11/1988 Geller et al. ..... 175/45
4,823,888 A 4/1989 Smet ..... 175/45
4,854,397 A 8/1989 Warren et al.
4,858,704 A 8/1989 McDonald et al. ..... 175/61
4,867,255 A 9/1989 Baker et al. ..... 175/61
4,907,658 A 3/1990 Stangl et al. ..... 175/19
4,953,638 A 9/1990 Dunn ..... 175/61
4,991,667 A 2/1991 Wilkes, Jr. et al. ..... 175/61
4,995,465 A 2/1991 Beck et al.
5,020,608 A 6/1991 Oden et al. ..... 175/21
RE33,793 E 1/1992 Cherrington et al. ..... 175/61
5,289,887 A 3/1994 Püttmann ..... 175/61
5,337,002 A 8/1994 Mercer ..... 324/326
5,421,420 A 6/1995 Malone et al. ..... 175/61
5,431,046 A 7/1995 Ho
5,449,046 A 9/1995 Kinnan ..... 175/24
5,469,155 A 11/1995 Archambeault et al. . 340/853.4
5,513,713 A 5/1996 Groves ..... 175/73
5,553,678 A 9/1996 Barr et al. ..... 175/73
5,556,253 A 9/1996 Rozendaal et al. ..... 414/797.7
5,585,726 A 12/1996 Chau ..... 324/326
5,607,280 A 3/1997 Rozendaal ..... 414/745.7
5,633,589 A 5/1997 Mercer ..... 324/326
5,698,981 A 12/1997 Mercer ..... 324/326
5,713,422 A 2/1998 Dhindsa
5,746,278 A 5/1998 Bischel et al. ..... 175/24
5,764,062 A 6/1998 Mercer ..... 324/326
5,767,678 A 6/1998 Mercer ..... 324/326
5,778,991 A 7/1998 Runquist et al. ..... 175/61
5,884,716 A 3/1999 Beasley
5,941,320 A 8/1999 Austin et al. ..... 175/27
5,941,322 A 8/1999 Stephenson et al. ..... 175/62
6,085,852 A 7/2000 Sparks et al. ..... 175/52
6,109,371 A 8/2000 Kinnan ..... 175/61

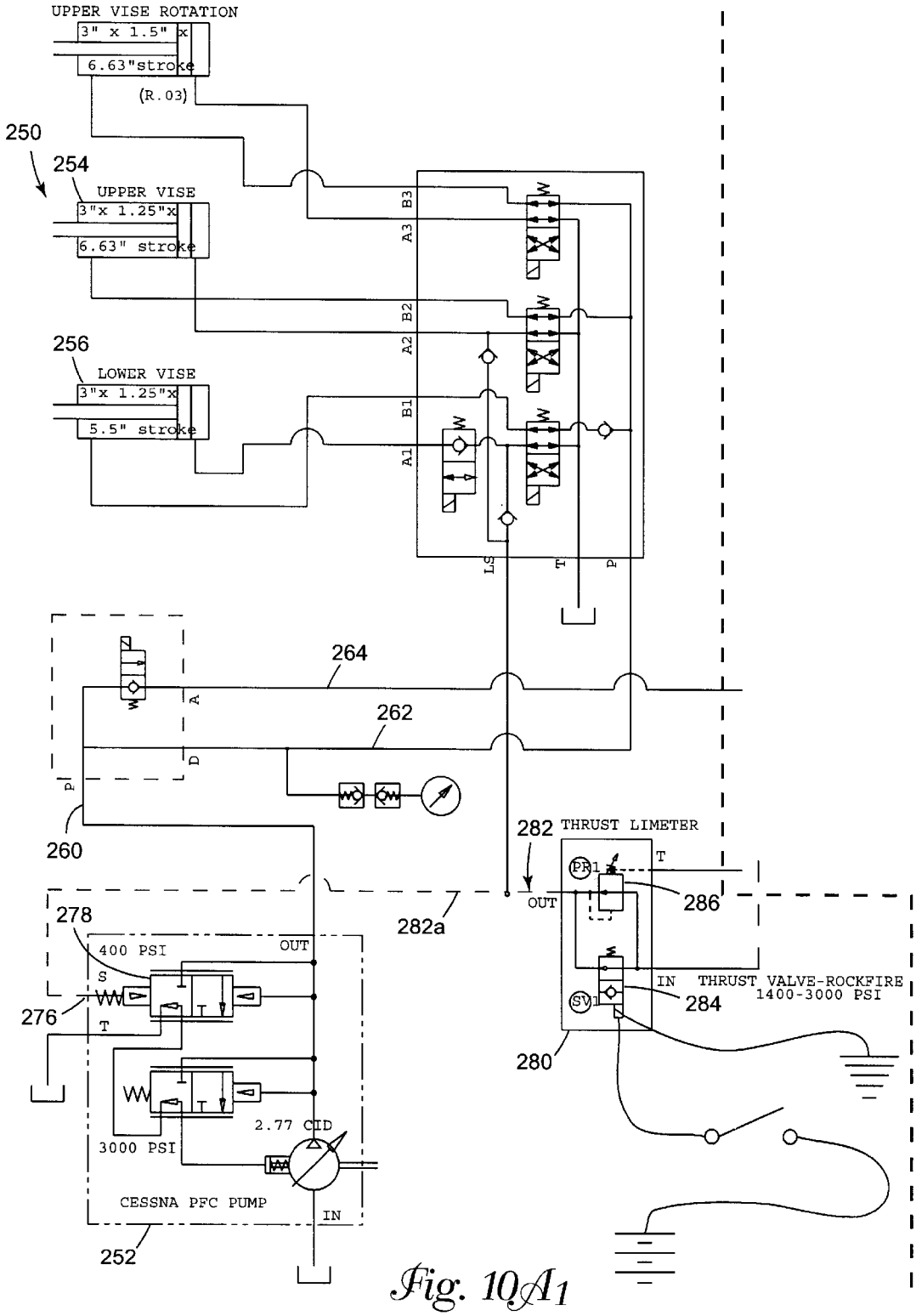
Fig. 10A1

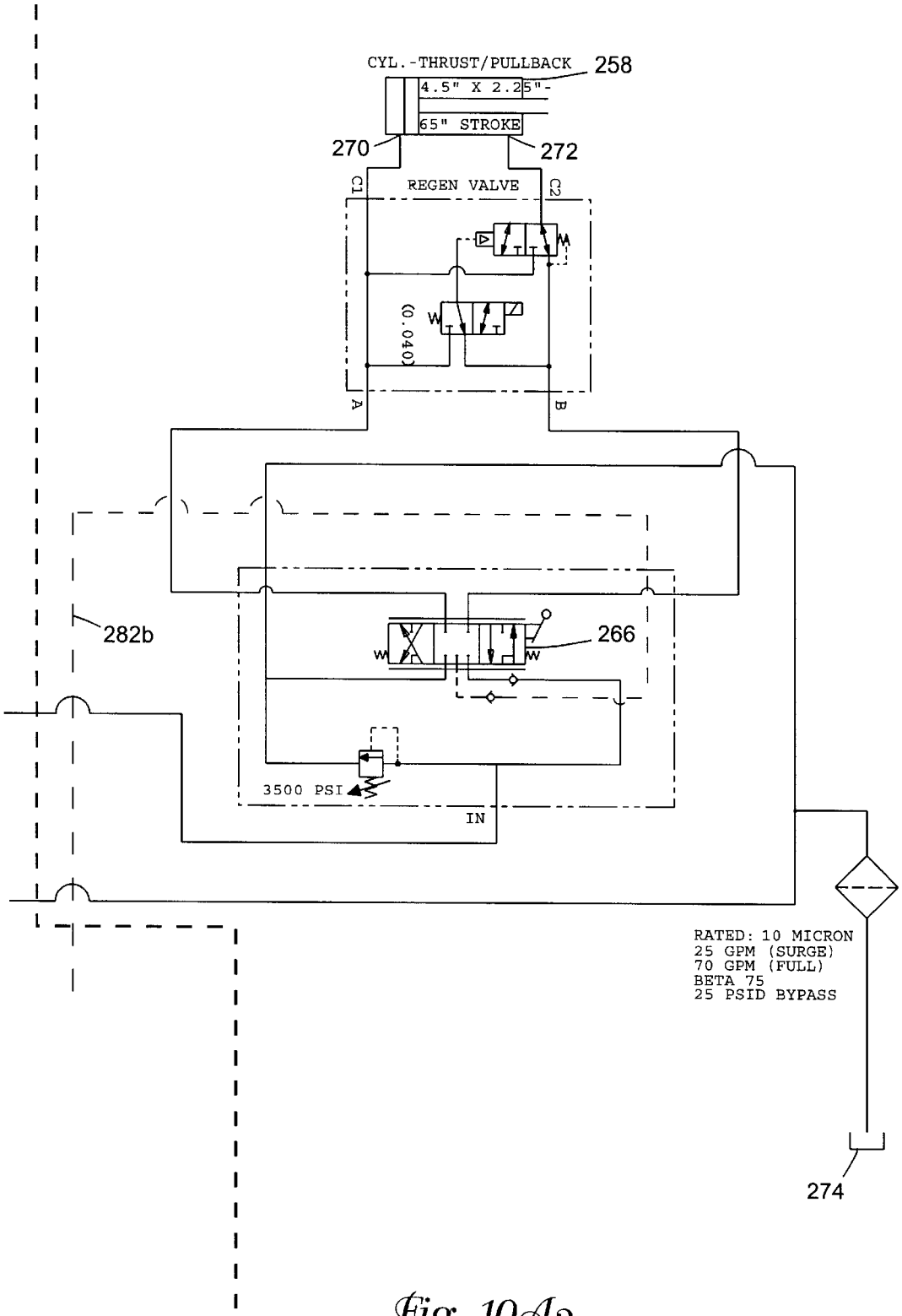
*Fig. 10A2*

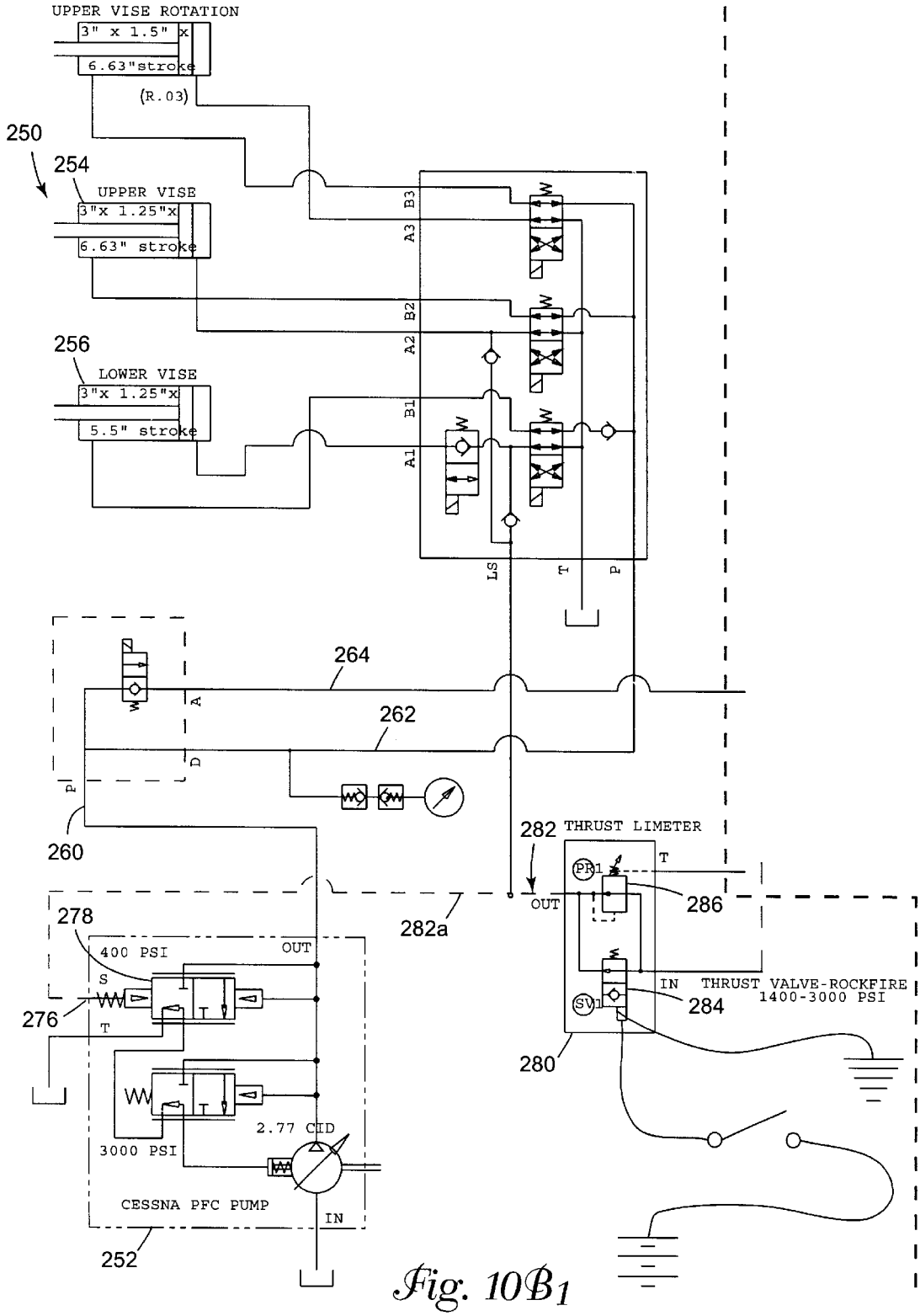
*Fig. 10B1*

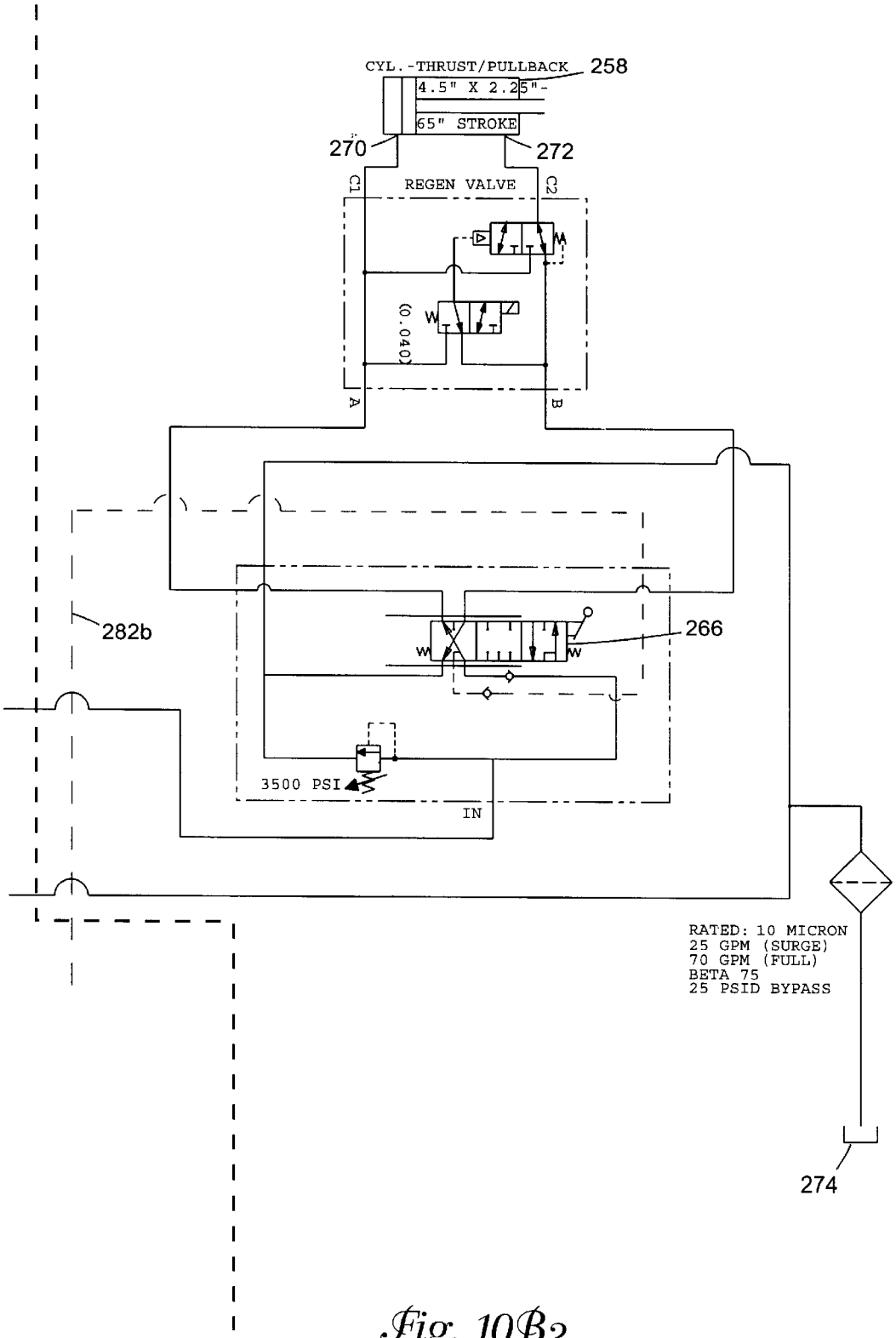
*Fig. 10B2*

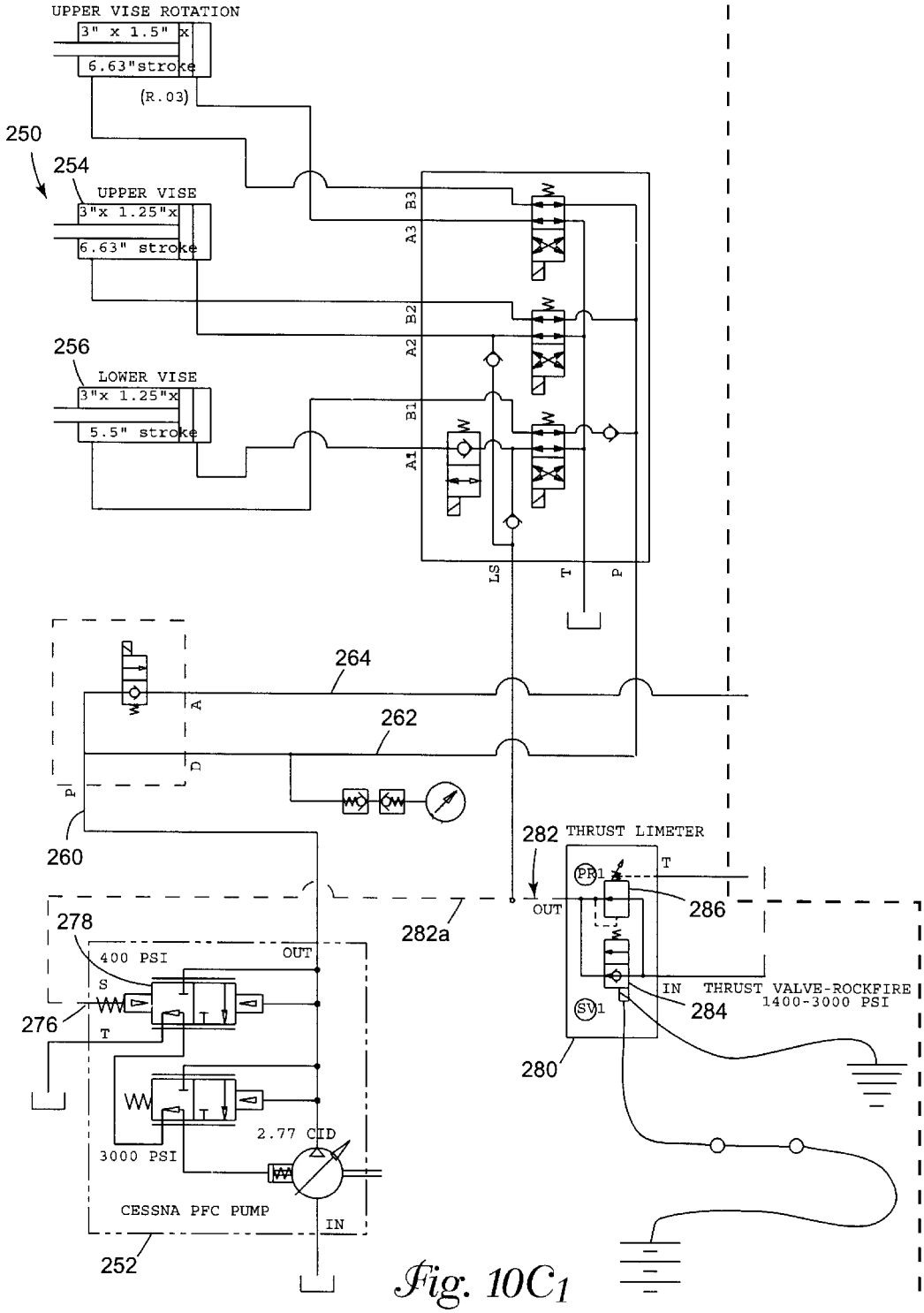
*Fig. 10C1*

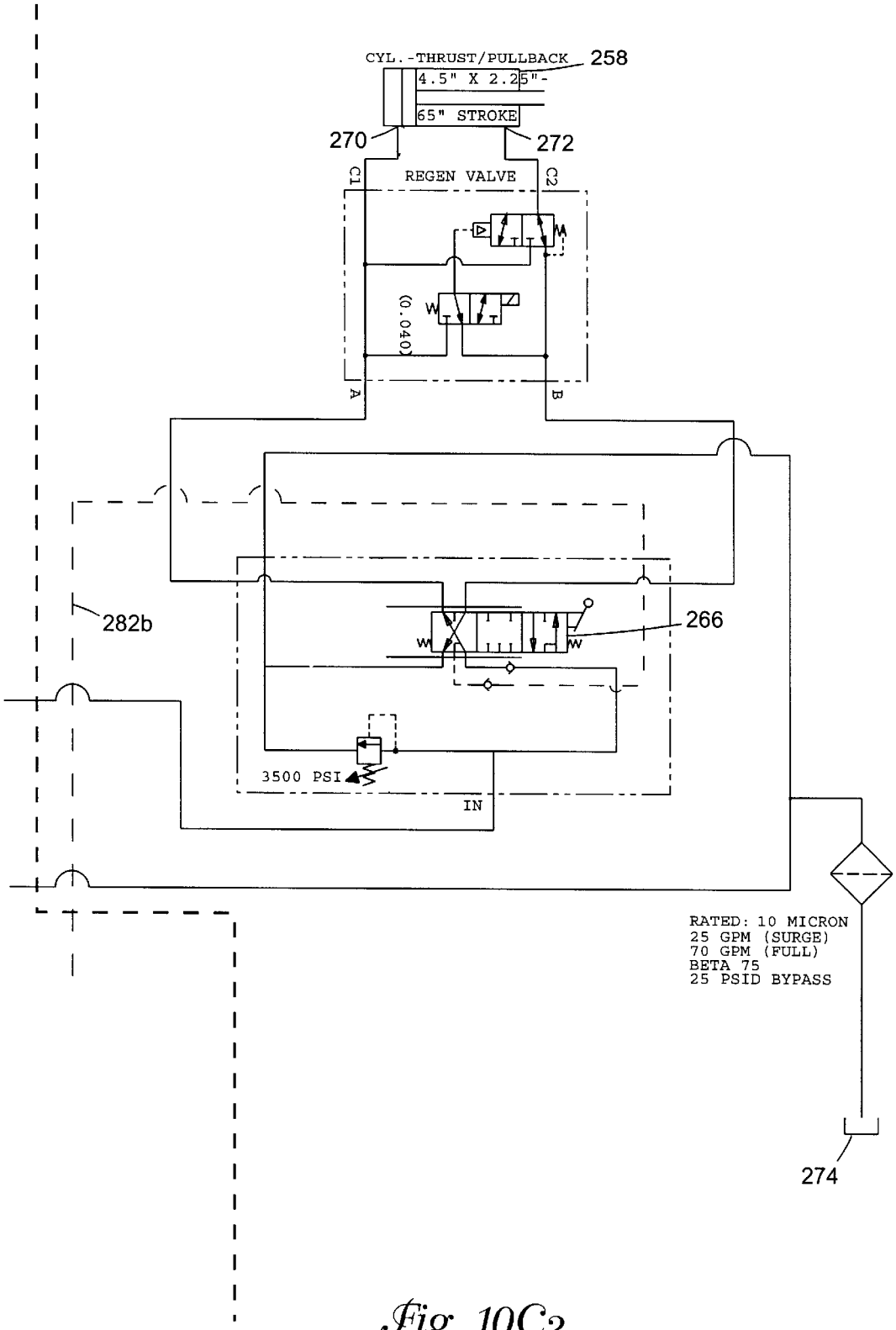
*Fig. 10C2*

DIRECTIONAL DRILLING MACHINE AND METHOD OF DIRECTIONAL DRILLING

RELATED APPLICATIONS

This application is a continuation-in-part of application Ser. No. 09/525,408, filed Mar. 15, 2000, now U.S. Pat. No. 6,357,537, which is hereby incorporated herein by reference in its entirety.

FIELD OF THE INVENTION

This invention relates in general to underground drilling/boring systems and methods, and more particularly to a method and apparatus for automatically controlling the thrust force incident on one or more drill rods forming the drill string of the underground boring system.

BACKGROUND OF THE INVENTION

Utility lines for water, electricity, gas, telephone, cable television, digital communication and computer connections are among the many types of physical lines or cables often run underground. Generally, it is desirable to bury these lines for reasons of safety and aesthetics. In many situations, the underground utilities can be buried in a trench, which is subsequently back-filled. Although useful in areas of new construction, the burial of utilities in a trench has certain disadvantages. In areas supporting existing construction, a trench can cause serious disturbance to structures or roadways. Further, there is a high probability that digging a trench may damage previously buried utilities, and that structures or roadways disturbed by digging the trench are rarely restored to their original condition. Also, the trench poses a danger of injury to workers and passersby.

The general technique of boring a horizontal underground hole has been developed to overcome the disadvantages described above, as well as others unaddressed when employing conventional trenching techniques. In accordance with such a general horizontal boring technique, also known as microtunnelling or trenchless underground boring, a boring system is positioned on the ground surface. The boring system is arranged to drill a hole into the ground at an oblique angle with respect to the ground surface. Fluid is flowed through the drill string, over the boring tool, and back up the borehole in order to remove cuttings and dirt. After the boring tool reaches the desired depth, the tool is then directed along a substantially horizontal path to create a horizontal borehole. After the desired length of borehole has been obtained, the tool is then directed upwards to break through to the surface. A reamer is then attached to the drill string which is pulled back through the borehole, thus reaming out the borehole to a larger diameter. It is common to attach a utility line or conduit to the reaming tool so that it is dragged through the borehole along with the reamer.

The length of a desired bore may be substantial. In order to create a drill string of sufficient length to create the desired bore, many fixed lengths of drill rods may be attached end-to-end. More particularly, a first drill rod is placed on the machine rack and forced into the ground. A subsequent length of drill rod is placed on the machine and coupled to the first length, generally via threads on each drill rod. The combined length is then further forced into the ground. In order to form a complete bore, numerous drill rods are added in this fashion during the boring operation. As rods are added, the drill string length and the resulting bore length increases.

An operator of a conventional underground boring tool typically modifies the rate of boring tool advancement. The thrusting force can be manually varied by the operator based on many parameters including the desired speed of drill string advancement and soil conditions. However, in an effort to maximize drilling speed, an operator may apply more thrust force than can safely be applied to one or more of the drill rods without its becoming damaged or destroyed. The operator will be unaware of how much thrust force can be applied without causing such damage. Therefore, the operator may apply too little thrust force which results in drilling inefficiencies, or may alternatively apply too much force and damage the drill string.

There is a need in the underground boring industry to minimize such problems and assist drilling operators in carrying out drilling processes. Additionally, there continues to be a need for an improved underground boring machine that provides for high boring efficiency through varying ground conditions, yet minimizing delays and costs associated with drill string damage, without depending on human intervention. The present invention fulfills these and other needs, and provides additional advantages over the prior art.

SUMMARY OF THE INVENTION

To overcome limitations in the prior art described above, and to overcome other limitations that will become apparent upon reading and understanding the present specification, the present invention generally discloses a system, apparatus and method for automatically limiting the thrust force applied to a drill string during an underground boring process, in order to prevent the deformation or collapse to the drill rods due to reaching the "yield" point of the rods.

In accordance with one embodiment of the invention, a method is provided for controlling the underground transit of a drill string. One or more drill string characteristics that influence the yield point of the drill string, or portions of the drill string, are determined. The yield point of the drill string or portion is computed, where the yield point is computed as a function of the drill string characteristics. The thrust force imparted to the drill string is adjusted in response to the computed yield point.

In accordance with another embodiment of the invention, a method is provided for controlling the subterranean advancement of one or more drill rods forming a drill string. An unsupported (or relatively little-supported) length of the drill string is measured. For example, one or more drill rods forming the drill string that has an unsupported portion may be measured. The yield point of the drill string portion is calculated as a function of the unsupported length of the drill string. The thrust force imparted to the drill string is limited to a maximum allowable thrust force such that the yield point will not be reached.

In accordance with yet another embodiment of the invention, a method is provided for controlling the movement of a drill string, where the drill string is moved along an underground path. A bend radius is determined for at least a portion of the drill string along the underground path. The yield point of the drill string portion is computed as a function of the bend radius. The thrust force imparted to the drill string is adjusted in response to the computed yield point.

In accordance with another embodiment of the invention, a system for controlling the underground transit of a drill string is provided. The system includes a thrust engine to generate a thrust force for advancing the drill string. At least one drill string sensor is provided to sense drill string characteristics impacting a yield point the drill string or drill string portion. A controller is coupled to the drill string sensors and the thrust engine. The controller calculates the yield point of the drill string portion as a function of the drill string characteristics, and generates a thrust force adjustment signal based on the calculated yield point. The magnitude of the thrust force is dependent on the thrust force adjustment signal.

In still another embodiment, a horizontal drilling machine for directionally drilling a drill string into the ground is provided. The drill string includes a plurality of elongated rods threaded together in an end-to-end fashion. The machine includes a track, a rotational driver for rotating the drill string about a longitudinal axis of the drill string, and a thrust mechanism for propelling the rotational driver along the track. Also included is a thrust limiter that prevents the thrust mechanism from applying a thrust load to the drill string that exceeds a thrust load limit established at least in part by a buckle point of a drill string portion. The thrust load limit is less than a maximum thrust load that can otherwise be generated by the thrust mechanism.

These and various other advantages and features of novelty which characterize the invention are pointed out with particularity in the claims annexed hereto and form a part hereof. However, for a better understanding of the invention, its advantages, and the objects obtained by its use, reference should be made to the drawings which form a further part hereof, and to accompanying descriptive matter, in which there are illustrated and described specific examples of an apparatus in accordance with the invention.

BRIEF DESCRIPTION OF THE DRAWINGS

The invention is described in connection with the embodiments illustrated in the following diagrams.

DETAILED DESCRIPTION OF THE INVENTION

In the following description of the exemplary embodiment, reference is made to the accompanying drawings which form a part hereof, and in which is shown by way of illustration the specific embodiment in which the invention may be practiced. It is to be understood that other embodiments may be utilized, as structural and operational changes may be made without departing from the scope of the present invention.

Generally, the present invention provides a system and method for automatically limiting or throttling the thrust force applied to a drill string during an underground drilling/boring process, in order to ensure that segments of drill rods do not deform, collapse or become otherwise damaged by reaching the "yield" point (also referred to as the "buckle" point) of the rods. The buckling/yield point of a rod is the stress limit at which permanent deformation takes place in a material. The automatic thrust limiting is accomplished by monitoring characteristics of the drill string (or portion thereof) that potentially impact the yield point of the drill string portion being scrutinized. From these characteristics, the yield point of the drill string portion may be determined. While the thrust force applied to the drill string may be upwardly adjusted to optimize drilling efficiency, the thrust force in any event is limited such that the yield point of the drill string will not be reached. The thrust source (e.g., thrust motor) is thus precluded from generating a thrust force capable of causing one or more rods of the drill string to reach the yield point, which would potentially deform, collapse or otherwise damage the rod(s).

The present invention is applicable to underground boring systems and methodologies, and a description of a representative underground boring machine is thus provided. As will be readily apparent to those skilled in the art from a reading of the description provided herein, other types of underground boring systems are clearly within the scope of the invention, and the invention is not limited to the exemplary drilling machine embodiment provided herein.

Figure 1:
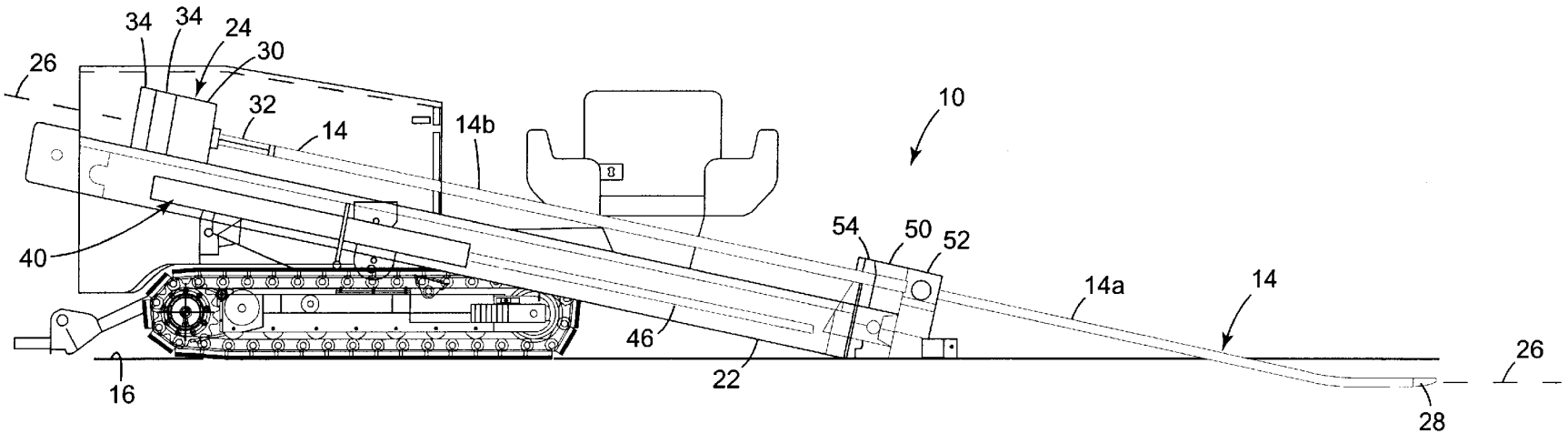
FIG. 1 depicts an exemplary embodiment of an underground boring device in which the principles of the present invention may be applied.

FIG. 1 depicts an exemplary embodiment of an underground boring or tunneling apparatus, also known as a horizontal directional drilling (HDD) device, in which the principles of the present invention may be applied. Generally, such a device may be used in assembling, rotating, advancing, withdrawing and disassembling a drill string. A drill string typically refers to a plurality of mating rod or pipe sections arranged head to tail and releasably threaded together. The drill string may be forced through the ground in order to form a bore through the ground in which a cable, conduit, wire or the like may be passed through. Because such activity results in an underground bore, it is often referred to as "trenchless drilling."

More particularly, FIG. 1 depicts an exemplary underground boring machine 10 that incorporates the novel apparatus and method for limiting the thrust applied to the drill string, in order to prevent buckling of an unsupported length of drill rod. The apparatus and method for limiting drill string thrust will be described generally herein with reference to a hydrostatically powered boring machine. It will be appreciated, however, that the present invention may be advantageously implemented in a wide variety of underground boring machines having components and configurations differing from those depicted for illustrative purposes herein.

The drilling machine 10 is adapted for pushing a drill string 14 into the ground 16, and for pulling the drill string 14 from the ground 16. The drill string 14 includes a plurality of elongated members 14*a,* 14*b* (e.g., rods, pipes, etc.) that are connected end-to-end. A drill head 28 is generally mounted at a remote end of the drill string 14 to facilitate driving the drill string 14 into the ground 16. The drill head 28 may include, for example, a cutting bit assembly, a starter rod, a fluid hammer, a sonde holder, as well as other components. Each of the rods 14*a,* 14*b* includes a mechanism for connection therebetween, such as threaded ends. A threaded male end on one end of rod 14*a,* for example, may be threaded into a threaded female end on rod 14*b*. The series of rods coupled in such a manner comprises the drill string 14.

The drilling machine 10 includes an elongated guide or track 22 that can be positioned by an operator at any number of different oblique angles relative to the ground 16. A rotational driver or pump 24 is mounted on the track 22. The rotational driver 24 is adapted for rotating the drill string 14 in forward and reverse directions about a longitudinal axis 26 of the drill string 14. As used herein, the terms "forward direction" and "forward torque" refer to the direction of rotation of the drill string that tends to engage or tighten the threads of members 14*a* and 14*b*. For example, if members 14*a* and 14*b* have right-hand threads, the forward direction of rotation or torque is in a clockwise direction. The terms "reverse direction" and "reverse torque" refer to the direction of rotation of the drill string that tends to loosen or disengage the threads of members 14*a*, 14*b*.

The rotational driver 24 includes a gear box 30 having an output shaft 32 (i.e., a drive chuck or drive shaft). The gear box 30 may be powered by hydraulics, pneumatics, electricity, internal combustion engine, or any other technology or device known for generating torque. In the illustrated example, the gear box 30 is powered by two hydraulic motors 34. It will be appreciated that different numbers of motors 34 may be coupled to the gear box 30, depending largely upon the amount of torque that is desired to be generated by the rotational driver 24.

The rotational driver 24 is adapted to slide longitudinally up and down the track 22. For example, the rotational driver 24 can be mounted on a carriage (not shown) that slidably rides on rails (not shown) of the track 22 as shown in U.S. Pat. No. 5,941,320, the content of which is hereby incorporated by reference. A thrust mechanism 40 is provided for propelling the rotational driver 24 along the track 22. For example, the thrust mechanism 40 moves the rotational driver 24 in a downward direction (indicated by arrow 42) to push the drill string 14 in the ground 16. By contrast, the thrust mechanism propels the rotational driver 24 in an upward direction (indicated by arrow 44) to remove the drill string 14 from the ground 16. It will be appreciated that the thrust mechanism 40 can have any number of known configurations. The exemplary thrust mechanism 40 of FIG. 1 includes a hydraulic cylinder 46 that extends along the track 22. In one embodiment, the hydraulic cylinder 46 is coupled to the rotational driver 24 by a chain drive assembly (not shown), where the chain drive assembly may include a chain that is entrained around pulleys or gears in a block and tackle arrangement such that an incremental stroke of the hydraulic cylinder 46 results in an increased displacement of the rotational driver 24. For example, in one particular embodiment, the chain drive assembly displaces the rotational driver 24 a distance equal to about twice the stroke length of the hydraulic cylinder 46. Directional drilling machines having a chain drive arrangement as described above are well known in the art, and, for example, are used on various directional drilling machines manufactured by Vermeer Manufacturing Company of Pella, Iowa.

While one particular thrust arrangement for moving the rotational driver 24 has been described above, the present invention contemplates that any number of different configurations can be used. For example, one or more hydraulic cylinders can be coupled directly to the rotational driver 24. Alternatively, a rack and pinion arrangement could also be used to move the rotational driver 24. Furthermore, a combustion engine, chain or belt drive arrangements, and other arrangement that do not use hydraulic cylinders can also be used.

Referring still to FIG. 1, the drilling machine 10 further includes upper and lower gripping units 50 and 52 for use in coupling and uncoupling the elongated members 14*a* and 14*b* of the drill string 14. The upper gripping unit 50 includes a drive mechanism 54 (e.g., a hydraulic cylinder) for rotating the upper gripping unit 50 about the longitudinal axis 26 of the drill string 14. The gripping units 50 and 52 can include any number of configurations adapted for selectively preventing rotation of gripped ones of the elongated members 14*a* and 14*b*. For example, the gripping units 50 and 52 can be configured as vice grips that, when closed, grip the drill string 14 with sufficient force to prevent the drill string 14 from being rotated by the rotational driver 24. Alternatively, the gripping units 50 and 52 can include wrenches that selectively engage flats provided on the elongated members 14*a* and 14*b* to prevent the elongated members from rotating.

To propel the drill string 14 into the ground 16, the rotational driver 24 is positioned at an uppermost location (shown in FIG. 1), and the drill head 28 is gripped within the lower gripping unit 52. The elongated member 14*a* is then placed in axial alignment with the output shaft 32 of the rotational driver 24 and the drill head 28. Once alignment has been achieved, the rotational driver 24 rotates the output shaft 32 in a forward direction. This causes the shaft 32 to thread into the female threaded end 20 of the elongated member 14*a*, and the male threaded end of the elongated member 14*a* to concurrently thread into the female threaded end of the drill head 28. The drill head 28 is prevented from rotating by the gripping unit 52. During the threading process, the rotational driver 24 advances downward to ensure that the lower end of the elongated member 14*a* contacts the drill head 28 and the upper end of the elongated member 14*a* contacts the output shaft 32. Preferably, the forward torque provided by the rotational driver 24 is limited by a torque limiter to ensure that the drive shaft 32 does not exceed a predetermined torque. The forward torque used to provide the threaded connection between the drive shaft 32 and the elongated member 14*a* is called the "make-up torque." In one embodiment, the make-up torque is about 67% of the maximum forward torque that the rotational driver 24 can provide when the torque limiter is not active. It will be appreciated that the magnitude of the make-up torque is dependent upon the diameter or size of the elongated members being used. For example, for a 2.375 inch diameter pipe, a make-up torque of about 2400 ft-lb would preferably be used. The make-up torque would be larger for a larger diameter pipe, and lower for a smaller diameter pipe. For example, the make-up torque for a 3.5 inch diameter pipe is preferably about 6000 ft-lb, and the make-up torque for a 1.9 inch diameter pipe is preferably about 1200 ft-lb.

After the first elongated member 14*a* has been coupled to the drive shaft 32 and the drill head 28, the lower gripping unit 52 releases the elongated member 14*a* and the rotational driver 24 is propelled in a downward direction along the track 22 such that the elongated member 14*a* is pushed into the ground 16. As the elongated member 14*a* is pushed into the ground 16, the rotational driver 24 preferably rotates the elongated member 14*a* such that the drill head 28 provides a boring or drilling action. After the elongated member 14*a* has been fully pushed into the ground 16, the trailing end of the elongated member 14*a* is gripped by the lower gripping unit 52 to prevent rotation of the elongated member 14*a*. Once the trailing end of the elongated member 14*a* has been gripped by the lower gripping unit 52, the rotational driver 24 applies a reverse torque to the drive shaft 32 to break the joint formed between the drive shaft 32 and the elongated member 14*a*. By way of example, the reverse torque needed to break the joint can be in the range of 50 to 70% of the make-up torque. The torque used to break a joint can be referred to as the "break-out torque." Thus, when it is desired to break a joint, a reverse torque provided by the rotational driver 34 of sufficient torque is provided in order to break the joint.

Once the joint has been broken, the drive shaft 32 is completely unthreaded from the elongated member 14*a*, and the rotational driver 24 is moved upward along the track 22 to the uppermost position (e.g., the position shown in FIG. 1). Next, the elongated member 14*b* is placed in alignment with the elongated member 14*a* and the drive shaft 32, and the sequence described above is repeated. Thereafter, depending upon the length of the hole to be drilled, additional elongated members can be added to the drill string in the same manner described above.

As the drill string 14 is pushed into the ground 16, the drill string 14 is preferably steered so as to generally follow a path that has been predetermined by the operator. Commonly, the drill head includes an active sonde (e.g., a device capable of generating a magnetic field) that can be tracked by a locator provided at the ground surface to determine the location of the drill string 14 underground.

In operating the boring machine 10, various steering techniques may be employed. One particular steering technique involves rocking or oscillating the drill head 28 back and forth (e.g., the drill string 14 and the attached drill head 28 are rotated back and forth in the forward and reverse directions). Preferably, the drill head is rocked back and forth along a limited arc (e.g., an arc less than 360 degrees, such as a 180 degree arc or a 90 degree arc) while the drill string 14 is concurrently thrust into the ground by the thrust mechanism 40. This results in a steering technique that provides a cutting action during both the forward rotation of the drill head 28 and the reverse rotation of the drill head 28. During the steering action, a thrust limiter can be used to control the thrust output provided by the thrust mechanism 40 such that the thrust provided to the drill string 14 does not exceed a preset thrust pressure limit.

To withdraw the drill string 14 from the ground 16, the rotational driver 24 is moved upward along the track 22 from the lowermost position to the uppermost position. As the rotational driver 24 moves upward, the elongated member 14*b* is pulled from the ground 16. When the rotational driver 24 reaches the uppermost position, the elongated member 14*a* is gripped by the lower gripping unit 52, and the elongated member 14*b* is gripped by the upper gripping unit 50. Thereafter, the upper gripping unit 50 is rotated about the longitudinal axis 26 by the drive 54 to break the threaded joint between the two elongated members 14*a* and 14*b*. Once the joint has been broken, the upper gripping unit 50 is released and the rotational driver 24 applies reverse torque to the elongated member 14*b* to completely unthread the elongated member 14*b* from the elongated member 14*a*.

During the unthreading process, the rotational driver 24 moves upward. After the two members 14*a* and 14*b* have been uncoupled, the rotational driver 24 moves further upward to separate the members 14*a* and 14*b*. Thereafter, the elongated member 14*b* is again gripped with the upper gripping unit 50 to prevent rotation of the elongated member 14*b*. As the elongated member 14*b* is held by the upper gripping unit 50, the rotational driver 24 applies full reverse torque to the elongated member 14*b* such that the threaded joint between the drive shaft 32 and the elongated member 14*b* is broken and completely unthreaded. During this unthreading process, the rotational driver 24 moves further upward. After the shaft 32 and the member 14*b* have been uncoupled, the rotational driver 24 moves still further upward to separate shaft 32 from the member 14*b*. Once separation has been provided, the elongated member 14*b* is removed from the drilling machine 10, and the rotational driver 24 is returned to the lowermost position.

At the lowermost position, the drive shaft 32 is threaded into the elongated member 14*a* to provide a threaded connection thereinbetween. During the threading process, the lower gripping unit 52 prevents the elongated member 14*a* from rotating. Preferably, in providing such connection, the torque provided by the rotational driver 24 is equal to the make-up torque. After the connection is made, the lower gripping unit 52 is released and the rotational driver 24 is moved along the track 22 from the lowermost position to the uppermost position such that the elongated member 14*a* is withdrawn from the ground 16. The upper clamping unit 50 is then activated to engage the elongated member 14*a*, and the lower gripping unit 52 is activated to grip the drill head 28. Subsequently, the upper clamping unit 50 is rotated to break the connection between the drill head 28 and the member 14*a*. Thereafter, the member 14*a* is uncoupled from the drill head 28 and the output shaft 32 in the same manner described above with respect to the elongated member 14*b*.

During use, the drill string being advanced into the ground by the drilling machine 10 may encounter tremendous strain due to the thrust force and the opposing subterranean forces. If too much thrust force is applied, the strain on the drill string may cause at least a portion of the drill string to experience bending or flexing. If the amount of bending or flexing is beyond the malleable limits of the drill rods, permanent deformation or collapse of a portion of the drill rod can occur. If too little thrust force is applied to the drill string, the underground boring operation may not be operating as efficiently as it should be. It is therefore desirable to optimize the amount of thrust force that should be applied during underground drilling operations, and to protect the drill string from costly and time-consuming damage or collapse.

Figure 2:
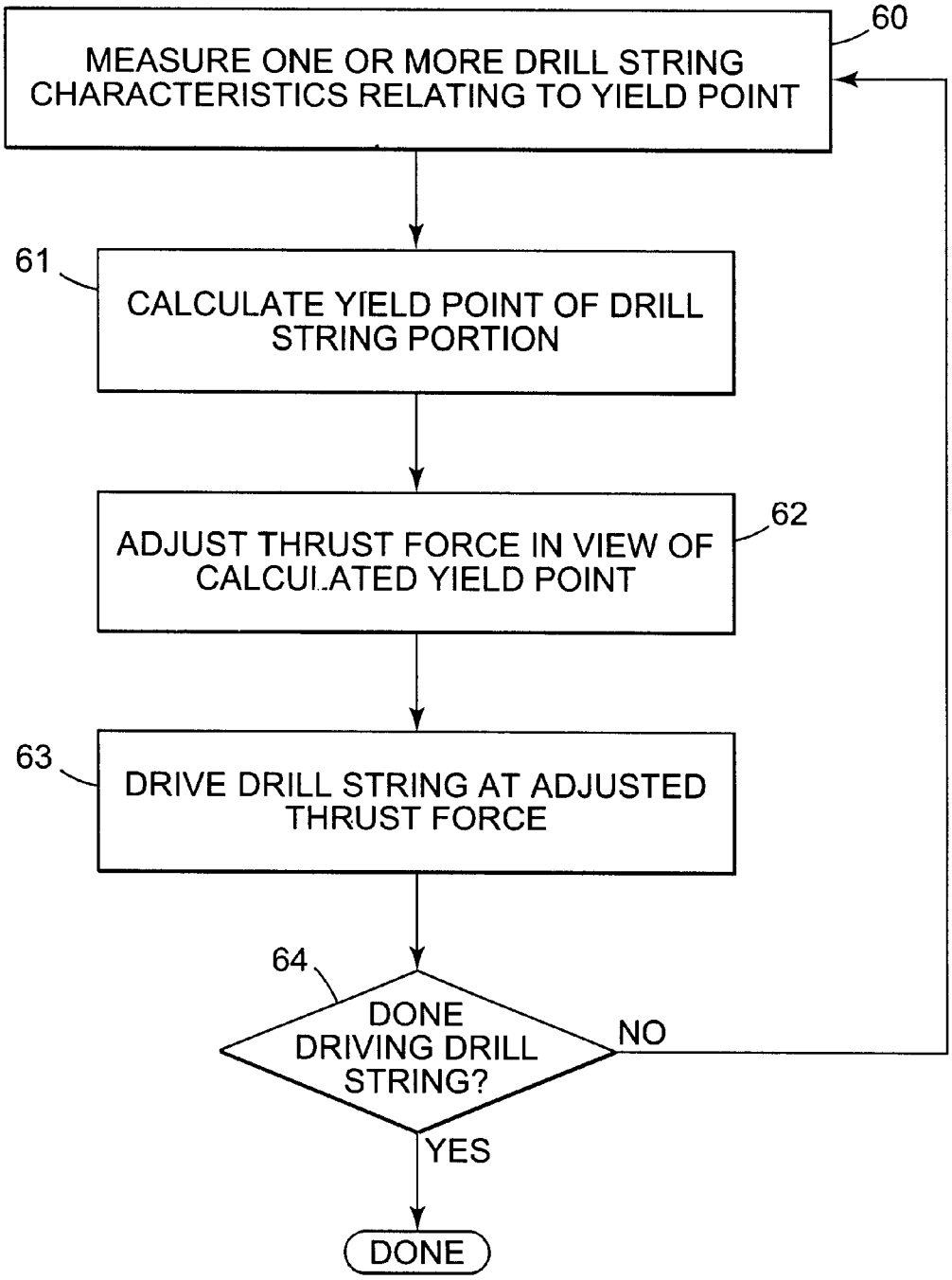
FIG. 2 is a flow diagram illustrating a method of controllably limiting thrust in accordance with the principles of the present invention.

Referring now to FIG. 2, a flow diagram illustrating a method of controllably limiting thrust in accordance with the principles of the present invention is provided. In the illustrated embodiment of FIG. 2, drill string characteristics that potentially impact the yield point of all or a portion of the drill string are measured 60. The drill string or portion thereof (i.e., one or more drill rods of the drill string) that is measured depends on the particular drill string characteristics sought. For example, in one embodiment described more fully below, the drill string characteristics sought includes the unsupported rod length of a rod being advanced into the ground. More particularly, a rod that has an unsupported portion may be the rod currently coupled to the gear box, at least a portion of which has not yet been advanced into the ground, thereby leaving an "unsupported" portion. In another embodiment discussed more fully below, the drill string characteristics of interest include the bend radius of the drill string or portion thereof. The aforementioned drill string characteristics are relevant in an inquiry of whether or not the drill string or drill string portion could potentially reach a yield or buckle point, causing damage or collapse of the portion of interest. Drill string characteristics having an impact on the yield point, other than those specifically identified, may also be measured 60 in accordance with the principles of the invention.

Once measured, the collected drill string characteristics are used to calculate 61 the yield/buckle point (i.e., the yield force or buckle force) at which the drill string portion would buckle. The thrust force, which also impacts the yield point, is adjusted 62. This thrust force adjustment is a function of the calculated yield point, such that the thrust force will not be allowed to reach the yield point. Where the thrust force is "adjusted," it can be adjusted upwards or downwards. In the case where the actual requested thrust force to be applied is relatively far from reaching the yield point, the thrust force may be adjusted upwards to increase the thrust force in an attempt to increase the speed and efficiency in which the boring process occurs. On the other hand, the thrust force will be adjusted downwards if the thrust force crosses a predetermined threshold or falls within a predetermined range from the yield point. The drill string is driven 63 at the adjusted thrust force value, in order to create the desired bore in the earth. The adjusted thrust force is subject to change, as the drill string characteristics being measured are likely to change, thereby causing a commensurate adjustment in the applied thrust force.

Until completing driving the drill string as determined at decision block 64, the process of adjusting the thrust force continues as illustrated by the return line to block 60. This continual adjusting may result from repeated drill string characteristic measurements, which can be performed on a periodic time basis, or may be performed as fast as the monitoring circuitry allows. It should be noted that while the feedback path from decision block 64 to block 60 is meant to illustrate the use of multiple drill string characteristic measurements, the measurements need not be performed in the serial nature depicted by the example shown in FIG. 2. Instead, these drill string characteristic readings may be taken at any desired periodicity (whether synchronous or asynchronous), and the rate of change of the actual, limited thrust force may be as often as necessary to maintain the desired thrust level. For example, the actual thrust applied may be updated every three seconds, or may be updated every tenth of a second. In either case, the thrust limiting feature of the present invention is utilized. However, the more often the drill string characteristics are measured, the more precise and uniform the resulting applied thrust.

Figure 3:
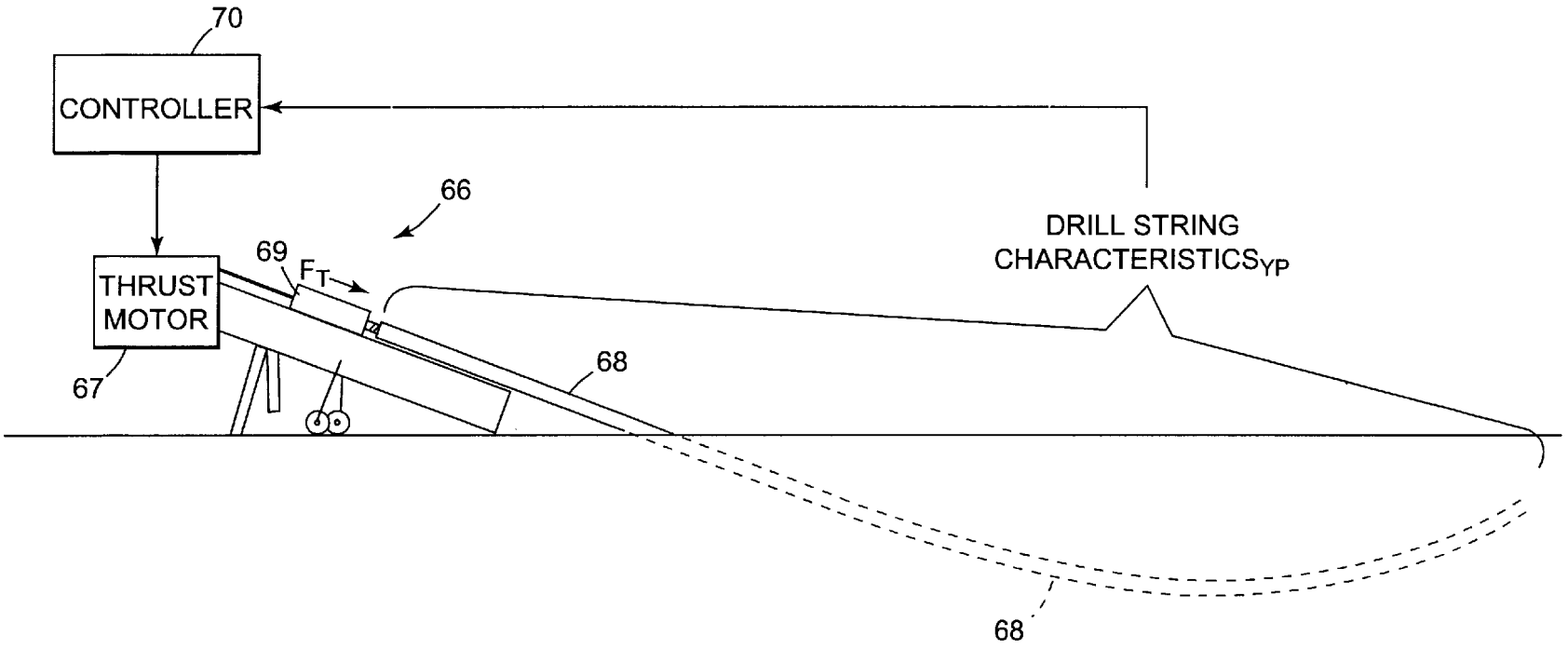
FIG. 3 is a block diagram depicting an example of a thrust limiting system in accordance with the present invention.

FIG. 3 is a block diagram depicting an example of a thrust limiting system in accordance with the present invention. The underground boring machine 66 of FIG. 3 includes a thrust motor 67 that applies an axially directed force to a drill string 68 in a forward axial direction during the creation of a bore. The thrust motor 67 provides varying levels of controlled force when thrusting the drill string 68 into the ground to create a bore, and when pulling back on the drill string when extracting the drill string 68 from the bore during a back reaming operation. The gear box 69 serves as the rotation pump driving a rotation motor and provides varying levels of controlled rotation to the drill string 68 as it is thrust into the ground during a boring operation, and for rotating the drill string 68 when extracting it from the bore during a back reaming process. An engine or motor (not shown) may provide power, typically in the form of pressure, to both the thrust motor 67 and the gear box 69, although each may be powered by separate engines or motors.

As indicated above, the thrust motor 67 provides varying levels of controlled force when thrusting the drill string 68 into the ground to create a bore. The force generated by the thrust motor 67 is imparted to the gear box 69 coupled to the drill string 68. The gear box 68 thus imparts a thrust force, $F_T$, on the rod 64 as it is pushed into the ground.

Certain characteristics relating to the drill string are measured. The drill string characteristics referred to in FIG. 3 relate to characteristics that would tend to affect the amount of force that can safely be applied without reaching the yield point of the drill string portion being analyzed. The drill string characteristics$_{YP}$ thus refer to those characteristics relating to the yield point, such as the bend radius of the drill string or the unsupported rod length subject to the applied thrust force.

The measured drill string characteristics$_{YP}$ may be in any form, including a digital signal or an analog sensor value. The appropriate conversion from one form to the other, or other signal processing, may be performed on the drill string characteristics$_{YP}$ signals, depending on the input requirements of the controller 70. In one embodiment, the controller 70 includes a processing system capable of accepting signals indicative of the drill rod characteristics$_{YP}$, calculating the yield point, and sending a signal(s) to the thrust motor 67 dictating the amount of thrust to be output from the thrust motor 67. The controller 70 thus processes the measured information, and causes the thrust motor 67 to adjust the actual thrust force accordingly. In this manner, the drill string 68 is protected from damage due to buckling. More information on manners of calculating yield points are provided below.

There are various embodiments in which drill string characteristics may be monitored and measured in order to calculate the appropriate yield point, and throttle the thrust force in response. Representative examples are provided below to facilitate an understanding of the invention.

Generally, the following embodiment of the present invention provides a system and method for automatically limiting or throttling the thrust force applied to the drill string during an underground boring process, in order to ensure that segments of drill rods do not deform, collapse or become otherwise damaged by reaching the buckling or yield point of the rods. A portion of the drill string at great risk of deformation or buckling is the drill rod(s) being advanced, but not yet fully into the ground, as at least a portion of the rod(s) will be "unsupported" by the subterranean structure. The unsupported portion of the rod(s) generally refers to the portion of the rod(s) that is not supported by the thrust mechanism or the ground. However, even where the rod at least partially in the ground, the subterranean structure may be inadequate to support the rod to the point to prevent it's buckling. For example, the entry area of the rod into the ground may include loose sand or dirt, which lends little resistance to buckling. Or, a widened opening lending some small degree of structural support to the drill rod may be insufficient to prevent buckling. Therefore, the "unsupported" portion of the drill rod need not be entirely free from any level of support. Rather, the insufficiently-supported rod portion has an insufficient physical structure proximate the periphery of the rod to resist a potentially damaging deviation angle on the rod. Therefore, references to the unsupported rod length provided herein do not necessarily imply that there is no structural support whatsoever along the "unsupported" portion of the rod.

By determining the length of the unsupported (or insufficiently-supported) portion of the drill rod, the yield or "buckling" point may be calculated. The thrust force produced by a thrust engine or thrust source (e.g., thrust motor, displacement pump, etc.) is then limited such that it will not generate a thrust force capable of causing the rod to reach the yield point. The drill rod is advanced at the limited thrust value, however the allowed thrust value may change as the length of the insufficiently-supported portion of the rod decreases.

Figure 4:
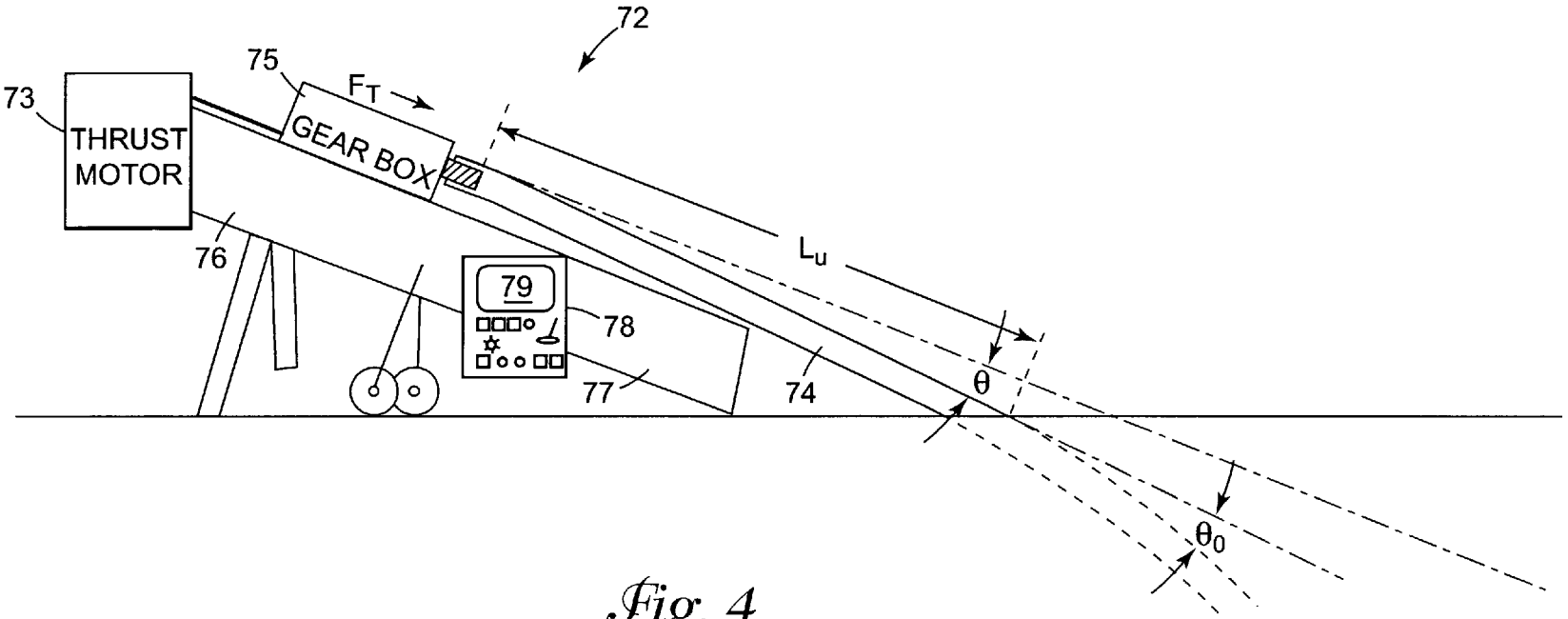
FIG. 4 is a block diagram of a representative embodiment of the invention, which further facilitates an understanding of a particular problem solved by the present invention.

Referring now to FIG. 4, a block diagram is provided to facilitate an understanding of one particular problem solved by the present invention. The underground boring machine 72 illustrated in FIG. 4 includes a thrust motor 73 which applies an axially directed force to a length of drill rod/pipe 74 in a forward and reverse axial direction. The thrust motor 73 provides varying levels of controlled force when thrusting the rod 74 into the ground to create a bore and when pulling back on the drill string when extracting the drill rod 74 from the bore during a back reaming operation. The gear box 75 serves as the rotation pump driving a rotation motor and provides varying levels of controlled rotation to the rod section 74 as it is thrust into a bore when the boring machine 72 is operating in a drilling mode, and for rotating the rod 74 when extracting it from the bore during a back reaming process. An engine or motor (not shown) may provide power, typically in the form of pressure, to both the thrust motor 73 and the gear box 75, although each may be powered by separate engines or motors. The mechanism used for facilitating the axial movement of the gear box 75, such as a track 76, is supported by the frame 77.

A control panel 78 may be mounted on the underground boring machine 72, which includes a number of manually actuatable switches, knobs, and levers for manually controlling the thrust motor 73, gear box 75, engine, and other components that are incorporated as part of the underground boring machine 72. The control panel 78 may include a display 79 on which various configuration and operating parameters are displayable to an operator of the boring machine 72. As will be described in greater detail hereinbelow, the display 79 preferably communicates to the operator various types of information associated with the operation of the boring machine 72.

As indicated above, the thrust motor 73 provides varying levels of controlled force when thrusting the rod 74 into the ground to create a bore. The force generated by the thrust motor 73 is imparted to the gear box 75 coupled to the drill string by way of rod 74. The gear box 75 thus imparts a thrust force, $F_T$, on the rod 74 as it is driven into the ground. The length of the rod 74 portion that is above ground versus the portion that is below ground changes depending on the axial position of the gear box 75 along the track 76. For example, when the gear box 75 is at it's initial position at the top of the track 76, and a new rod 74 is positioned and threaded between the gear box 75 and the drill string, substantially all of the rod 74 is "unsupported" above ground. In other words, when the rod is driven into the ground, the portion of the rod below ground is supported by the subsurface walls of the bore. The portion above ground, on the other hand, is unsupported by any structure (i.e., surrounded by air). The unsupported portion of the rod 74 in FIG. 4 is shown to have a length $L_u$, and this length changes as the rod 74 is thrust into the ground. The relationship between the force $F_T$ and the unsupported length $L_u$ is described more fully below.

If a column (e.g., drill rod) is relatively short, it will remain substantially straight when subjected to an axial compressive load. However, for longer columns, the compressive load may reach a certain critical value in which the column undergoes a bending action in which the lateral deflection becomes very large with little increase in load. This response is referred to as buckling, and may lead to the permanent deformation or collapse of the column.

In the present invention, each drill rod segment represents a column, and the length of the unsupported portion of the rod varies as the rod is driven into the ground. Thus, while the rod may exhibit low buckling characteristics when the unsupported rod length is relatively short (i.e., when a significant portion of the rod is in the ground), the unsupported rod length is substantial when a significant portion of the rod length is still on the rod loader, and may be in danger of buckling. Buckling is not a major concern if the thrust force is always perfectly along a non-deviating axis of the rod. However, the rod axis is generally not perfectly straight, and the applied forces may not be directed entirely axially with respect to the rod axis at all times.

The critical yielding or buckling point is dependent on various factors, including the thrust force $F_T$, the material and dimensions of the rod, and the unsupported length of the rod. Fluid is typically pumped through the drill string during underground drilling, thus requiring a hollow conduit through each rod, making inside and outside diameters pertinent to the buckling analysis as well. In accordance with the present invention, the thrust is controlled such that the axial force exerted on the rod does not exceed the buckling point of the rod.

In determining the buckling point, it is determined whether the system is disturbed so that the column or rod rotates through some angle from its support point. For example, if the rod rotates an angle θ between the line of force and the point of contact between the rod and the ground or the rod and the gearbox, the system may potentially buckle if the force is great enough. Further, imperfections in the rod itself, such that it is not perfectly straight with respect to the line of force, or where the force is not in perfect alignment with the axis of the bar, also affect the buckling point. These imperfections may be seen as imperfection angles $\theta_0$. An example formula that takes into consideration these concepts is set forth in Equation 1 below:

$$F_T L_u \sin(\theta+\theta_0)=k\theta \qquad \text{EQUATION 1}$$

where $F_T$ is the force applied, $L_u$ is the unsupported length of the drill rod, and k is the magnitude of the force resisting angular deviation of the rod at the points of support. A example of a rotation deviation angle θ and an imperfection angle $\theta_0$ are illustrated in FIG. 4. In the present invention, assumptions may be made relating to the potential angle rotation deviation θ and the imperfection angles $\theta_0$. Based on these assumptions, the material and dimensions of the rod, and by monitoring for the unsupported length of drill rod at any given instant, the buckling force may be calculated. By continually monitoring for the buckling point, the applied thrust force may be kept below the critical thrust force.

It should be recognized that other factors may be considered in determining the buckling force, and a variety of variations of the formula in Equation 1 may be used to determine a buckling force. The present invention is applicable regardless of the particular manner, mathematical equation, estimate, assumption, etc. that is used to identify a potential threshold force in which the thrust is to be limited. Therefore, Equation 1 is provided for purposes of illustration, however the invention is clearly not limited to such a formula, as those skilled in the art will readily appreciate.

It should also be recognized that while the description provided herein generally refers to "unsupported" lengths of drill rods, the present invention is also applicable to rod portions having some support, yet inadequate to prevent rod buckling. Thus, while the present invention generally indicates that an "unsupported" portion of a drill rod is the portion above ground, it should be recognized that the present invention may be applied to drill rods having a "lesser supported" portion. As a more particular example, where the portion of ground first entered by the drill rod is a soft or otherwise low-support substance, the present invention may apply to any portion of the rod that is not supported enough to prevent it's buckling. A low-support substance may include, for example, a very light or unpacked soil or sand structure that provides little support to the rod. Other examples may include a rocky substructure having air pockets that provide areas of little structural support. Those skilled in the art of underground boring processes will readily appreciate the various conditions of the earth may lack a desired amount of structural support for the drill rod, particularly near the entry point in the ground. While the present invention is described in terms of "unsupported" lengths of rods, it should therefore be recognized that the present invention is equally applicable to portions of drill rods subjected to some support, but less than what would keep the drill rods from buckling. Therefore, reference to unsupported portions of drill rods includes portions of rods encountering some structural support, but an inadequate amount of support to prevent rod buckling.

Figure 5:
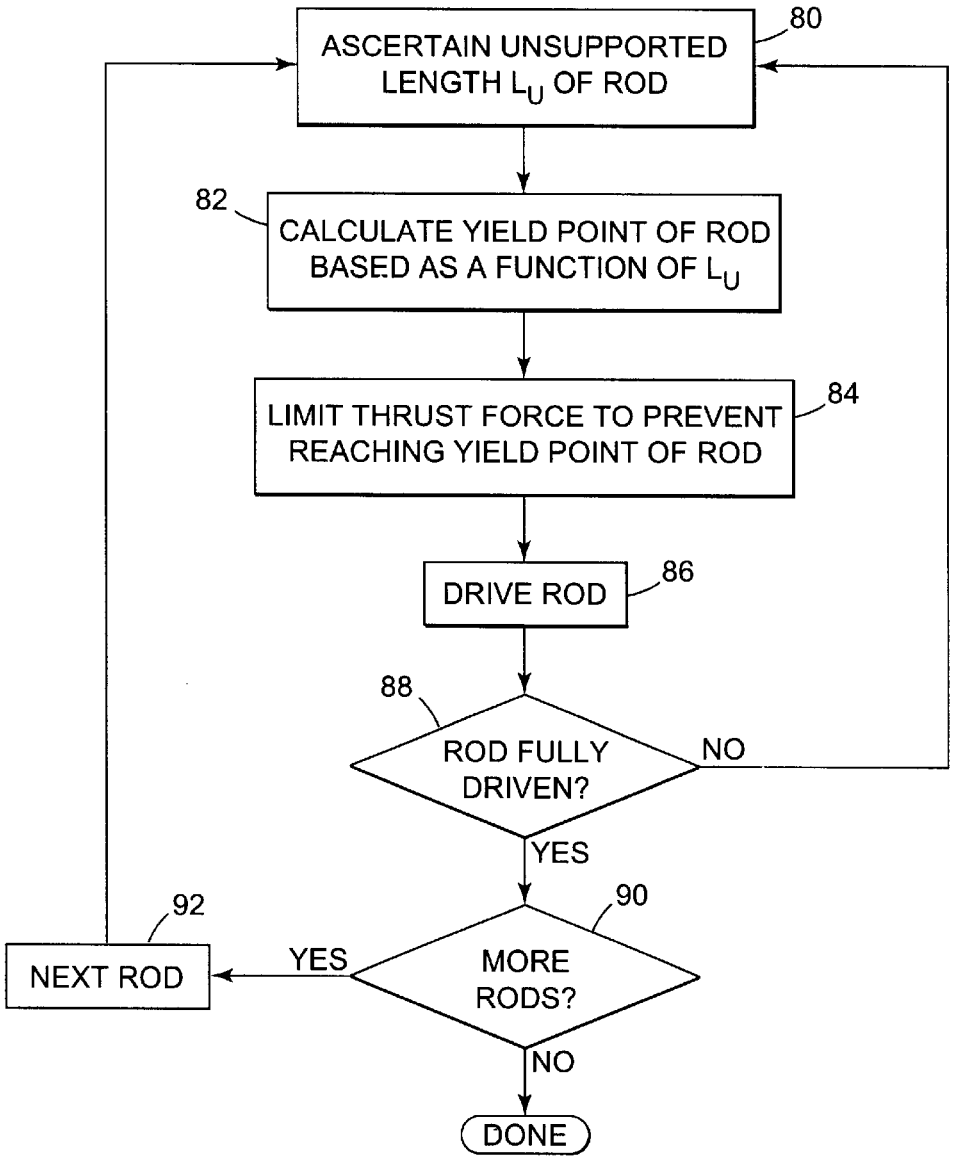
FIG. 5 is a flow diagram illustrating a method of controllably limiting thrust in accordance with the principles of the present invention.

FIG. 5 is a flow diagram illustrating a method of controllably limiting thrust in accordance with the principles of the present invention. In the illustrated embodiment of FIG. 5, the unsupported length $L_u$ of a rod being driven into the ground is ascertained 80 at a given time. The "unsupported" rod length $L_u$ refers to the portion of the rod that is still above ground, and thus unsupported by the bore walls or other subterranean structure. The unsupported rod length $L_u$ is thus dependent on how far a particular rod has been drilled into the ground. The length $L_u$ may be determined in a manner as described herein, or in a variety of other manners known in the art to automatically determine the length of a member.

In the embodiment of FIG. 5, the yield or "buckle" point of the rod is calculated 82 as a function of $L_u$. As described above, a length of rod may be subject to buckling where, for example, the rod is subject to a force having a non-axial vector force. In this case, the non-axial vector force is a force that has a direction that deviates from the axial direction of the rod, and may cause buckling of the rod. The longer the rod length, the less force required to reach the yield point of the rod. Depending on the length $L_u$ of the rod at a given instant, the corresponding yield point may be calculated 82.

Having determined the yield point of the rod as a function of the length of supported section of rod, the thrust force is limited 84 to prevent reaching the rod's yield point. For example, if the yield point is found to be approximately $F_Y$, then the actual applied thrust force $F_A$ imparted to the gear box, rod and drill string is limited such that $F_A<F_Y$. The rod is driven 86 into the ground using this limited applied force. However, the applied force $F_A$ will change as the rod advances into the ground, because the unsupported length $L_u$ decreases as the rod advances in this manner.

Until the rod is fully driven into the ground (i.e., the gear box reaches it's end position) as determined at decision block 88, monitoring of the unsupported rod length $L_u$ continues. This continual monitoring may be performed on a periodic time basis, or may be performed as fast as the monitoring circuitry allows. Alternatively, sensors may be used to sense the change of unsupported rod length $L_u$, and automatic updates to the current length reading may be recorded. A wide variety of other manners for effecting continuous, periodic, random, interrupt-driven, or other repeated monitoring of the unsupported rod length may be used in connection with the present invention. In accordance with one embodiment of the invention, the unsupported rod length is repeatedly measured at a rate dictated by the monitoring circuitry, and the resulting, updated length measurements are stored in a memory device for subsequent utilization in the yield point calculation. Therefore, while the feedback path from decision block 88 to block 80 is meant to illustrate the use of multiple length readings in connection with the invention, the length readings need not be performed in the serial nature represented by the example of FIG. 5. Instead, length readings may be taken at any desired periodicity (whether synchronous or asynchronous), and the rate of change of the actual, limited thrust force may be as often as necessary to maintain the desired thrust level and rod displacement rate. For example, the actual thrust applied may be updated every three seconds, or may be updated every tenth of a second. In either case, the thrust limiting feature of the present invention is utilized. However, the more often the rod length $L_u$ is updated, the more precise and uniform the resulting applied thrust.

When the gear box has fully driven the rod as determined at decision block 88, the process may be repeated for subsequent rods if more rods are to be added to the drill string. If more rods are to be added to the drill string as determined at decision block 90, each of these next rods are added 92 to the drill string by applying the process described above.

Figure 6:
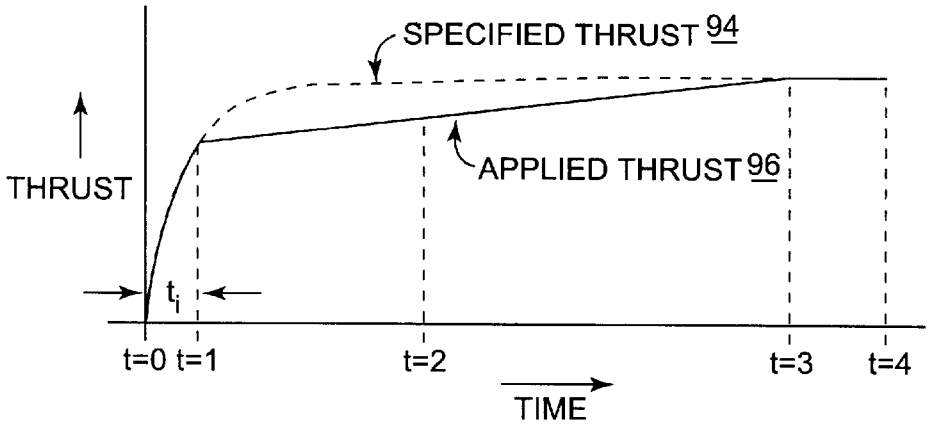
FIG. 6 is a graphical representation illustrating the thrust limiting principles in accordance with an embodiment of the invention.

FIG. 6 is a graphical representation illustrating the thrust limiting principles in accordance with an embodiment of the invention. The example representation of FIG. 6 illustrates a comparison of the desired or "specified" thrust versus the actual or "applied" thrust. The specified thrust 94 represents the desired thrust force to be applied to the subject drill rod and corresponding drill string. The applied thrust 96 represents the actual thrust force applied to the rod and corresponding drill string as limited in accordance with the invention.

The example of FIG. 6 shows that the applied thrust force is substantially equal to the specified thrust force during the period of time $t_i$ between time t=0 and t=1. During the time period $t_i$, the thrust motor has inherent mechanical inertia requiring a period of time to reach a particular thrust force from t=0. At some point, such as t=1, the thrust force may reach a point at which the yield point of the rod may be reached due to a sufficiently long unsupported rod length $L_u$. This results in initiating thrust limiting of the specified thrust 94 at t=1 in order to ensure that the rod does not bend or otherwise become damaged. In other words, the desired thrust (i.e., specified thrust) will not be allowed between time t=1 and t=3, in order to prevent damage to the rod.

The applied thrust 96 is represented by a line that approaches the specified thrust 94 with the passage of time. This is due to the decreasing unsupported length $L_u$ of the drill rod as it is advanced into the ground over time. Because the unsupported length of the rod is monitored over time, the buckling force as a function of rod length changes over time, and the applied thrust thus may be adjusted. For example, at time t=2, the unsupported rod length $L_u$ is shorter than at time t=1, and therefore the allowable applied force at t=2 may be greater than at time t=1. As the unsupported rod length continues to decrease as the rod is drilled into the ground, the applied force eventually reaches a point where it equals the desired or specified force, at time t=3. From this point on for the subject rod, the applied thrust is equal to the specified thrust, meaning that the specified thrust no longer requires limiting. This can be seen by the equal thrust values between times t=3 and t=4.

Figure 7:
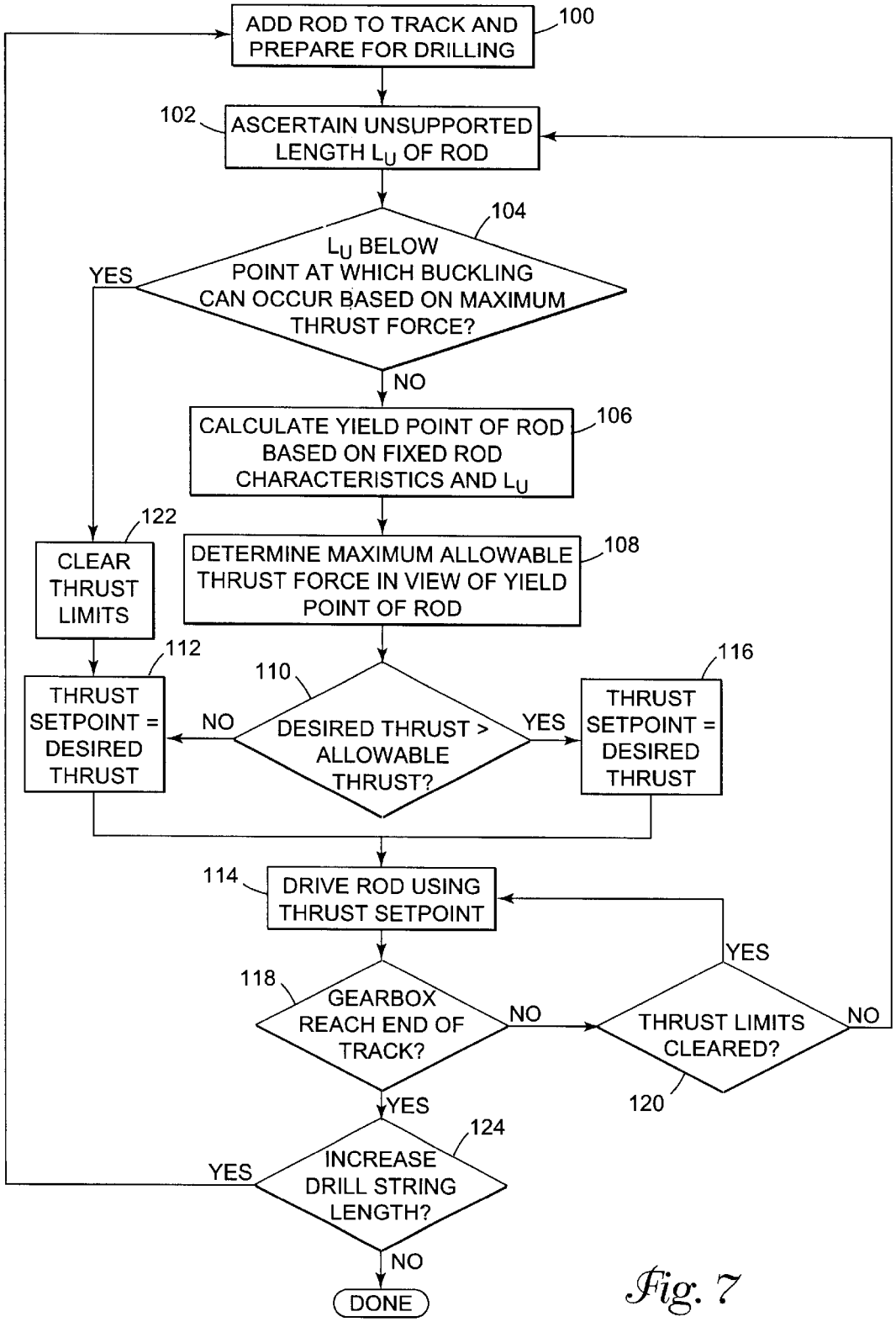
FIG. 7 is a flow diagram illustrating another method of controllably limiting thrust in accordance with the present invention.

FIG. 7 is a flow diagram illustrating another method of controllably limiting thrust in accordance with the present invention. The gear box retracts to it's rear position to facilitate the addition of a length of drill rod to the track as shown at block 100. In connection with adding the rod to the track, the rod is coupled to the gearbox and to the existing drill string (unless the rod is the first rod in the drill string). As described above in connection with one particular embodiment, the rod is coupled to the gearbox and drill string using threaded portions on the gear box, and on the rods forming the drill string.

Once the rod is coupled for drilling, the unsupported length $L_u$ of the rod may be ascertained 102. Determining the unsupported rod length $L_u$ allows for the subsequent calculation of the buckling (i.e., yield) point. As further described below, ascertaining the yield point is a continuous, or at least repeated process as the rod is driven into the ground. This is due to the changing unsupported length $L_u$ of rod as the rod is advanced through the underground bore.

When the unsupported rod length $L_u$ has been determined, one embodiment of the invention involves determining 104 whether the length $L_u$ is below a point at which buckling of the rod can occur, in view of the maximum thrust force that can be generated by the thrust motor or other thrust source. In other words, where the characteristics of the rod and the maximum force that can be generated by the thrust motor are known, it can be determined whether the unsupported length $L_u$ of rod is capable of even reaching the yield point. If the unsupported rod length $L_u$ still exhibits sufficient length to potentially reach the yield point, then the yield point of the rod is calculated 106. This calculation is based on certain physical characteristics of the rod and the unsupported rod length $L_u$. The physical characteristics of the rod may include the material properties of the rod, such as whether it is steel, the type of steel, the processing method used in making the rod, the inside and outside diameters of the cylindrical rod, and other physical characteristics relatively fixed for each of the rods used in the drilling process.

The maximum thrust force that will be allowed in view of the calculated rod yield point is determined 108. A predetermined differential factor may be used to determine the allowable thrust force in view of the calculated buckling force. For example, once the buckling force is known, the actual allowable thrust force to be applied to that rod will be set less than the buckling force by a predetermined amount, such as a 5% thrust force reduction.

The allowable thrust determined at block 108 is thus the maximum allowable thrust force that can be subjected to the rod at a particular unsupported rod length. However, the thrust force being requested by an operator or control system may actually be less than the allowable thrust force at that time. If the desired thrust is not greater than the calculated allowable thrust as determined at decision block 110, then the thrust setpoint need not be limited at all, but rather is set equal to the desired thrust as shown at block 112. The rod is then driven 114 in accordance with the thrust setpoint, which in this example is the desired thrust.

If the desired thrust is greater than the calculated allowable thrust as determined at decision block 110, then the thrust setpoint will be limited to the calculated allowable thrust as shown at block 116, and the rod will be driven 114 at this limited thrust setpoint. In other words, while the yield point of the rod in view of a particular unsupported rod length $L_u$ may be within the available thrust range of the thrust source, the operator or other control mechanism may not actually be requesting a thrust force that would exceed the critical threshold. Therefore, the thrust force only need be limited if the desired thrust force falls within a range capable of buckling the rod at the particular unsupported rod length.

If the gear box has reached the end of the track, then the particular rod has been advanced as far as the mechanical structure of the underground boring machine will allow. If the gear box has not reached the end of the track as determined at decision block 118, the rod is still being advanced, and the unsupported length of the rod can continue to be ascertained 102. This monitoring cycle will continue until the rod is no longer being advanced, the gear box has reached the end of its drive path, or other action.

In one particular embodiment, calculation of yield points can be terminated for a particular rod under certain circumstances, thereby allowing any thrust limits to be cleared. For example if the unsupported rod length $L_u$ is determined 104 to be below a point at which buckling can occur in view of the maximum thrust force that can be generated by the thrust motor/source, no yield point even calculation is necessary. In such case, the thrust limits can be cleared 122, the thrust setpoint is simply set 112 to the desired thrust force, and the rod is driven 114 at that thrust setpoint.

As an example, consider a ten foot drill rod having a set of known physical properties. In addition to these known properties, the maximum thrust capable of being produced by the thrust force source, such as a thrust motor or pump, is a quantity that can be ascertained. From these known quantities and rod properties, it can be determined that an unsupported three-foot rod length, for example, having known properties will never buckle using the particular thrust motor associated with the drilling machine. Once the unsupported rod length $L_u$ reaches this distance, the thrust limits can simply be cleared 122, and the rod can be advanced at the desired thrust force. The unsupported rod length will continue to decrease until the gear box reaches the end of the track as determined at decision block 118. However, until the gear box reaches the end of the track, the rod can continue to be driven at the desired thrust force as long as the thrust limits are cleared as determined at block 120. In other words, as long as the thrust limits are cleared due to a sufficiently short unsupported rod length in view of the maximum thrust capabilities of the thrust source, further calculations of the unsupported rod length and yield points are unnecessary for that particular rod. When the rod has been fully advanced by the gear box, the process may continue for subsequent rods if the drill string requires further length increases as determined at block 124. It should be recognized that the example of FIG. 7 represents one embodiment of the invention, and the invention is not limited thereto. Thus, the actual process may not monitor whether the thrust limits are cleared (e.g., monitor a thrust limit flag or indicator), but instead the unsupported rod length may continue to be monitored, and yield points and allowable thrust forces calculated regardless of whether the unsupported rod length exhibits a length no longer subject to buckling.

Figure 8:
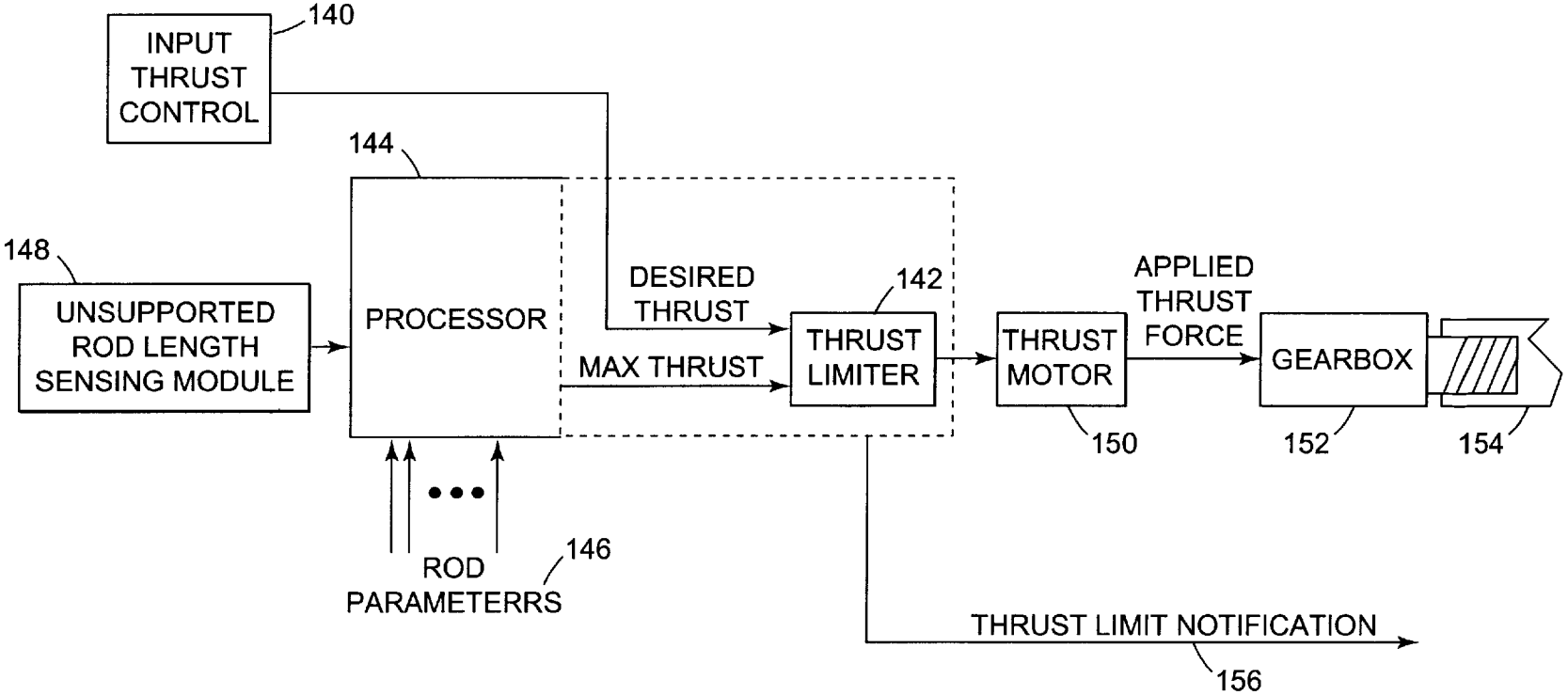
FIG. 8 is a block diagram illustrating one embodiment of a thrust limiting system in accordance with the present invention.

FIG. 8 is a block diagram illustrating one embodiment of a thrust limiting system in accordance with the present invention. The input thrust control 140 allows the desired thrust value to be entered. For example, the thrusting force can be varied by the operator based on many parameters including desired travel speed and soil conditions. The operator enters the desired thrust force via the input thrust control 140. In other embodiments, the desired thrust force may be programmed rather than requiring manual input by an operator, such that the desired thrust value provided by the input thrust control 140 is preconfigured, or determined by a computing system. For example, where a subterranean map is available, a predetermined drill plan may be established and programmed into the input thrust control 140. Alternatively, real-time feedback during a drilling process may be fed into a processing system to automatically determine what the desired thrust setting should be. An exemplary system for controlling an HDD device which may implement a thrust limiting methodology of the present invention is commonly owned U.S. patent application Ser. No. 09/405889, entitled "Real-Time Control System And Method For Controlling An Underground Boring Machine" filed on Sep. 24, 1999, the contents of which are incorporated by reference in its entirety. The calculated desired thrust setting is provided by the input thrust control module 140. It should be recognized that other manners of establishing and providing a desired thrust force are within the scope of the invention.

The desired thrust value is provided to a thrust limiting module 142. The thrust limiting module 142 may be implemented in hardware, or may be implemented as part of a programmable processing module. The processing module 144 shown in FIG. 8 performs a variety of functions, and the thrust limiting module 142 may optionally be implemented as part of the processor 144, as represented by the dashed lines encompassing the thrust limiting module 142. Alternatively, the thrust limiting module 142 may be implemented as part of the thrust motor 150.

The type of thrust limiting module 142 depends largely on the type of thrust motor used, and more particularly, the type of thrust control input required by the thrust motor 150. In one embodiment, the thrust motor 150 may be controlled by an analog input signal indicative of the thrust output. In another embodiment, a digital input signal is provided to the thrust motor 150. If the motor 150 is configured for digital signal control, a digital signal is derived and provided by the thrust limiter 142, or processor 144 as the case may be. For example, the thrust motor 150 may be controlled by digital signals in a hexadecimal range between 00h and FFh, such that a signal of 00h results in thrust force, and FFh results in generation of the maximum thrust force. This would allow for two-hundred fifty-six different settings for the applied thrust force signal. Depending on the desired continuity of the resulting thrust force, a larger or small number of settings may be used. If the thrust motor 150 is controlled by an analog signal, a digital-to-analog converter (DAC) at the input of the thrust motor 150 will convert the digital signal to the requisite analog signal. If the thrust motor 150 has an analog input, the digital-to-analog conversion must occur prior to sending the analog control signal.

The processing module 144 provides an allowable maximum thrust value to the thrust limiting module 142. The processor 144 determines the allowable maximum thrust as a function of various rod parameters 146 and the length of the unsupported portion of the drill rod that is above ground (i.e., the unsupported rod length $L_u$). As described earlier, the rod parameters include the material properties of the drill rod, rod dimensions, etc. Based on a buckle formula programmed into the processor 144, the thrust force may be limited such that it will not reach or exceed the buckle force (yield point) of the unsupported drill rod on the drill rack.

In the embodiment of FIG. 8, a rod length sensing module 148 is provided to determine the unsupported length of the drill rod. The unsupported rod length $L_u$ may be determined in the manner described herein, and in accordance with other length measuring devices. For example, the unsupported rod length sensing module 148 may include a mechanism to measure the actual length of the rod from the ground surface to the gear box attachment. Alternatively, the drill rods can include length identifiers that can be monitored by sensors located proximate the drill rods as they are advanced into the ground. These identifiers can include visually perceivable indicia, or chemical, magnetic, or other properties capable of being sensed. Any number of known or later-developed techniques for measuring the unsupported rod length of a member may be used in connection with the present invention. A number of such representative techniques are described more fully below.

Based on the unsupported rod length and the rod parameters, the processing module 144 generates an indicator corresponding to the allowable maximum thrust. The thrust limiting module 142 determines whether the desired thrust may be employed, or whether it must be limited to the allowable maximum thrust value. The result is provided to the thrust motor 150, which generates the applied thrust force in response thereto. This thrust is applied to the gear box 152, and consequently to the subject drill rod 154.

In one embodiment of the invention, the thrust force is electrically controlled and can be varied from zero to a pre-set maximum. In this manner, the control system allows the applied thrust force to be limited such that it will not reach the buckle force of the rod. If desired, the thrust limiting feature can be disengaged completely, such as by activation of a manual override switch, allowing full thrust force as desired by the operator or drill plan program.

In accordance with another embodiment of the invention, an operator may be notified when the underground boring system is subject to thrust limiting. The actual or applied thrust force, and an indication to the operator that the thrust force is being limited, may be displayed on a device accessible to the operator, such as the control panel display 79 shown in FIG. 4. The thrust limiting module 142 may produce a thrust limit notification signal as shown on line 156, in order to allow such information to be presented to the operator. In this manner, the operator is made aware if and when the actual thrust force being applied is less than the desired thrust force. Notification to the operator may be important to the operator, particularly because various conditions may exist in which thrust limiting may or may not be applied. For example, if the operator is not requesting a thrust force large enough to reach the buckle force of the unsupported portion of the drill rod, the thrust force need not be limited. Further, the unsupported rod length may reach a length small enough such that no thrust force capable of being generated by the particular thrust motor can buckle the rod. By notifying the operator when the thrust is being limited, it also allows the operator to become more skilled and efficient in applying the appropriate thrust force during the underground boring process.

As indicated above, a wide variety of measuring techniques for determining the length of the unsupported portion of a drill rod may be used in accordance with the invention. Some examples are provided below.

One manner of measuring the unsupported rod length of a drill rod as it is advanced into the ground is to use rack position sensors. The position sensors line the rack in order to determine the position of the gear box as it moves along the rack, and the position of the rod relative to the rack can be determined knowing the position of the gear box. From this gear box position information, the unsupported rod length can be determined. Alternatively, the position sensors may be positioned such that they monitor the location of the rod itself. For example, optical sensors can detect the presence of a rod positioned between the optical source and optical receiver, or may be used to distinguish the location of the rod from that of the gear box. The position sensors may be electrical contact switches, or mechanical position sensors. Any number of different types of position sensors may be used in accordance with the invention. In the case where multiple position sensors are used in a switching mode along the length of the drill rack, the result will be stepped thrust force changes as the thrust force may change each time a new position sensor indicates a change in the unsupported rod length.

A position transducer may also be used to determine the position of the rod relative to the rack. Position transducers convert mechanical motion into an electrical signal that may be metered, recorded, or transmitted. In one type of position transducer, an extension cable is wound on a threaded drum that is coupled to a precision rotary sensor such as an incremental encoder, absolute encoder, hybrid or conductive plastic rotary potentiometer, synchro, or resolver. Operationally, the position transducer is mounted in a fixed position along the rack, and the extension cable is attached to the gear box, or directly to the rod once it is attached to the gear box. The axes of linear movement for the extension cable and rod/gear box are aligned with each other. As movement occurs, the cable extracts and retracts as an internal spring maintains tension on the cable. The threaded drum rotates a precision rotary sensor that produces an electrical output proportional to the cable travel. The output is measured to reflect the position, direction, or rate of motion of the rod/gear box.

The transducers produce a signal indicative of whether the gear box, or rod as the case may be, is at a particular location on the rack. For example, if five feet of unsupported rod length is present at a given instant, the position transducers on a corresponding portion of the rack will indicate the presence of the rod, while the position transducers above the five-foot point on the rack will indicate the absence of the rod. In this manner, the position of the rod can be determined, and the unsupported rod length can be determined in response thereto, as the drill rod length and distance from the gear box to the ground are known parameters.

Another manner of determining the unsupported rod length includes manual input by the operator. For example, the operator may enter the unsupported rod length as it changes, or may repeatedly activate an input (e.g., press a button via a control panel or remote control unit) each time the unsupported rod length decreases by a predetermined amount. Activating the input will update a stored value for the unsupported rod length by decreasing the stored value by a predetermined amount corresponding to the ascertained decrease of the drill rod. For example, each rod may be equipped with visual indicia, such as visual symbols or impressions, at predetermined distances. As each visual indicia reaches ground level, the operator may indicate such through the user input, thereby updating the stored value of the unsupported rod length $L_u$.

Figure 9A:
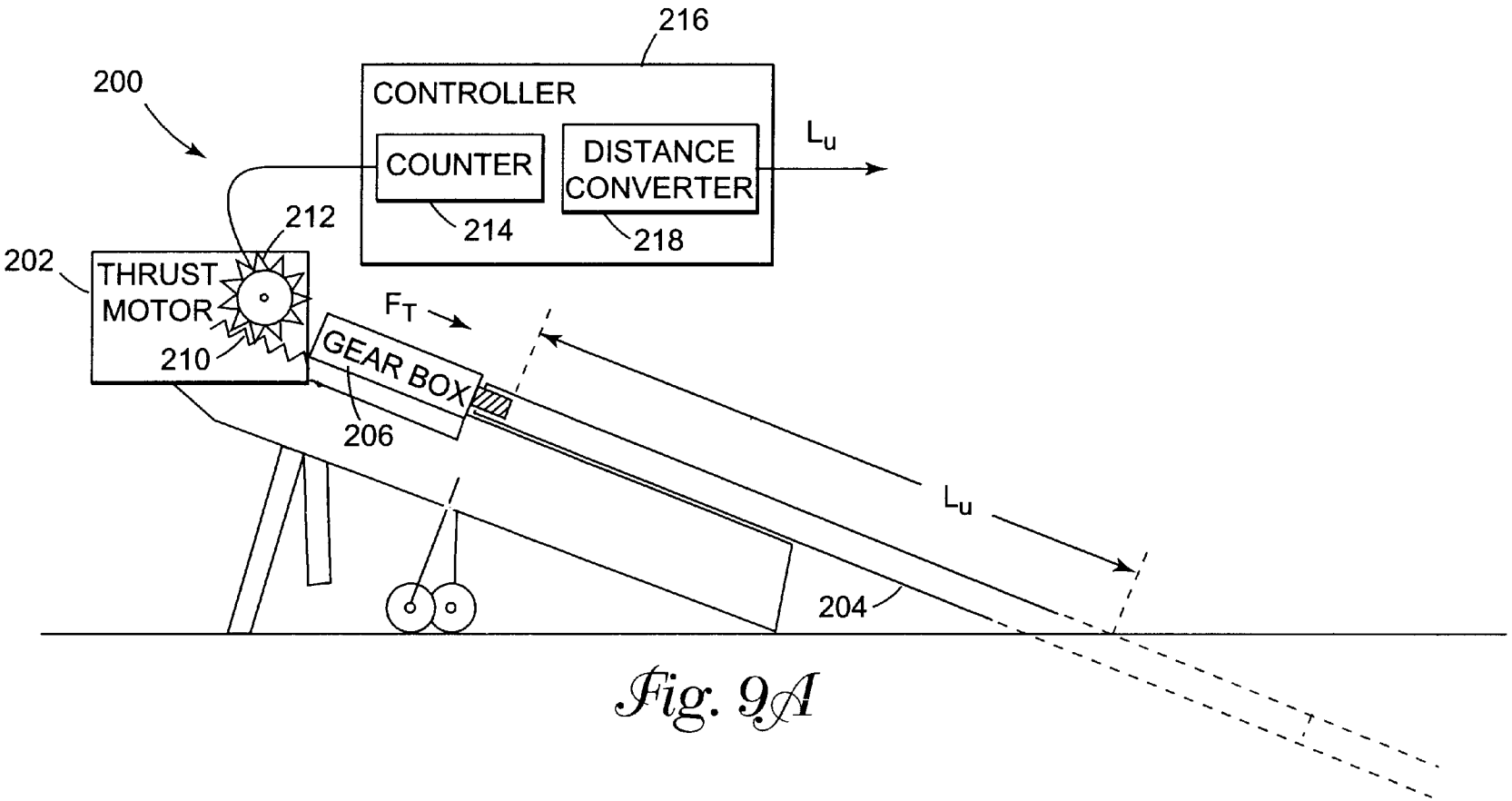
FIGS. 9A and 9B illustrate an exemplary rack and pinion drilling apparatus to drive the drill string, and further illustrates one manner of exploiting the rack and pinion mechanisms to determine the unsupported rod length $L_u$ of the drill string.
Figure 9B:
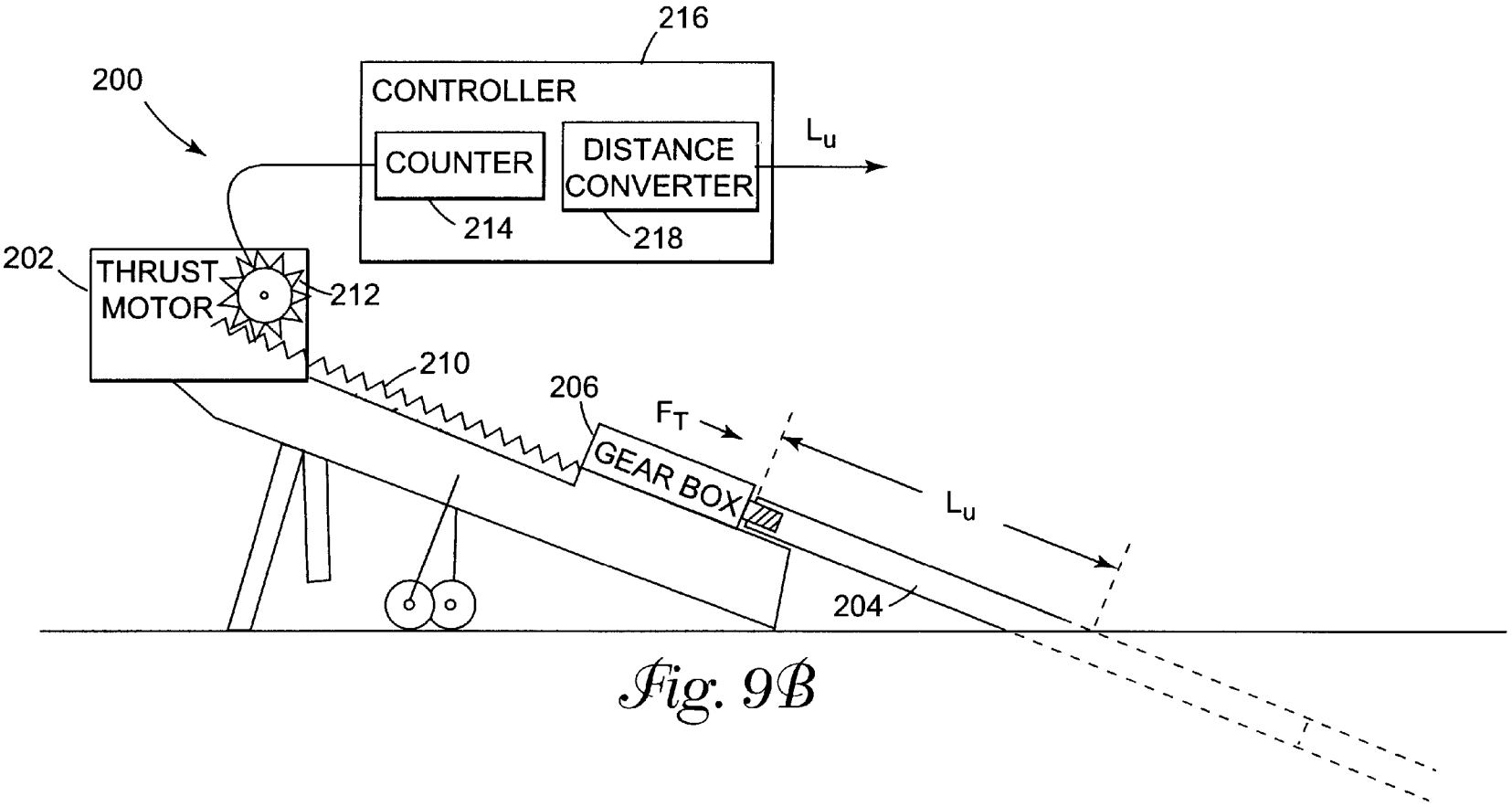

In one embodiment of an underground boring apparatus, yet another technique for determining the unsupported rod length $L_u$ may be used. In this drilling apparatus, a rack and pinion drive system is utilized to drive the gear box, and consequently the drill rod, into the ground to create the bore. FIGS. 9A and 9B illustrate such a rack and pinion drilling apparatus, and illustrate one manner of exploiting the rack and pinion mechanisms to determine the unsupported rod length $L_u$.

The underground boring machine 200 illustrated in FIG. 9A includes a thrust motor 202 to apply an axially directed force to a length of drill rod/pipe 204 in a forward and reverse axial direction. The thrust motor 202 provides varying levels of controlled force when thrusting the rod 204 into the ground to create a bore and when pulling back on the drill string when extracting the drill rod 204 from the bore during a back reaming operation. The thrust motor 202 applies the force to the gear box 206, which is in turn coupled to advance the rod 204 during drilling.

The unsupported portion of the rod 204 has a length $L_u$, which decreases as the rod 204 is advanced into the ground. The gear box 206 imparts a thrust force, $F_T$, on the rod 204 as the rod advances. In the example of FIG. 9A, the thrust motor 202 includes the rack and pinion drive system. The rack and pinion drive system is a gear arrangement including a toothed bar 210 that meshes with a pinion 212. The pinion 212 is powered to rotate, which causes the toothed bar 210 to move along the rack. The gear box 206 is coupled to the bar 210, causing the rod to be thrust into the ground as the pinion 212 is rotated.

In order to determine the unsupported rod length in the rack and pinion drive system of FIG. 9A, the movement of the pinion 212 can be monitored. More particularly, the gear teeth of the pinion 212 can be counted as the pinion is rotated to move the bar 210. Because the teeth of the pinion 212 are designed to mesh with the teeth of the bar 210, it can be determined how far the bar 210 travels for each pinion rotation of a gear tooth. For example, each "count" of the pinion gear teeth may equal one inch, or other length depending on the dimensions and gear ratio of the pinion 212 and bar 212. Knowing the initial position of the gear box 206, and counting one inch for each pinion rotation of one gear tooth, it can be determined how far the gear box moves on the rack. Thus, each count of the pinion 212 corresponds to a corresponding decrease (e.g., one inch) of the unsupported rod length $L_u$.

The manner in which the unsupported rod length may be determined in such a rack and pinion drive system is described in connection with FIGS. 9A and 9B. Each gear tooth of the rotating pinion 212 is counted by a counting module 214. The counter 214 may be an independent module, or may be associated with a processor or controller 216 as shown in FIG. 9A. The controller 216 is a programmable controller programmed to receive signals relating to the rotation of the pinion 212, and to store and update a corresponding count value. This count is converted to a distance by the distance converter 218 for use in determining the buckle or yield point of the drill rod. Again, the converter 218 may be implemented as an independent module, or as part of the controller 216. The converter 218 utilizes the count value of the counter 214 to determine how far the bar 210 has traveled, and thus the length of the unsupported rod length $L_u$.

The signals received by the counter 214 may be provided by a sensor or other mechanism to provide a signal relating to the rotation of the pinion 212. For example, the sensor can be a rotation sensor, designed to provide a pulse each time the pinion 212 rotates one gear tooth. In an embodiment having a 20-tooth pinion 212, a signal would be produced each time the pinion 212 rotates approximately eighteen degrees. Another embodiment includes using a pressure sensitive sensor, or a conductor, to sense the presence (or absence) of a pinion gear tooth. Each time a gear tooth contacts such a sensor, a signal can be provided to the counter 214. These and other sensing mechanisms may be used in accordance with the present invention.

As seen in FIG. 9B, the gear box 206 has traveled farther than in FIG. 9A. The counter value maintained by the controller 216 of FIG. 9B is therefore greater than the counter value maintained by the controller 216 of FIG. 9A, since the pinion 212 had to rotate farther to drive the gear box 206 to its distant location in FIG. 9B. The distance converter 218 of FIG. 9B thus reveals that the unsupported rod length $L_u$ is a lesser value than in the example of FIG. 9A, since the rod 204 has been driven farther into the ground.

A example formula that may be carried out by the controller 216 to provide a value for $L_u$ is shown in Equation 2 below:

$$L_{u0} - \left[\frac{(COUNT)(RACKDIST_{TOOTH})}{12}\right] = L_u \qquad \text{EQUATION 2}$$

In Equation 2, $L_{u0}$ is the initial unsupported rod length, such as ten feet. COUNT refers to the count value maintained in the counter 214, and $RACKDIST_{TOOTH}$ refers to the linear rack movement per pinion tooth rotation, such as one inch. The divisor of twelve simply provides a resulting unsupported rod length $L_u$ in feet (where the $RACKDIST_{TOOTH}$ is provided in inches).

Referring to FIG. 9A, if the initial unsupported rod length $L_{u0}$ is ten feet, the count has reached 40, and the rack movement per pinion tooth rotation is one inch, the resulting unsupported rod length is:

$$10 - \left[\frac{(40)(1)}{12}\right] = 6.67 \text{ feet}$$

This resulting value (e.g., 6.67 feet) can then be used in determining the yield point of the rod 204. In the example of FIG. 9B the gear box 206 has moved further, such that the COUNT may be, for example, a value of eighty. This would result in an unsupported rod length $L_u$ of 3.33 feet.

It should be recognized that various other embodiments for calculating the length of unsupported rod length may be used in accordance with the invention. Furthermore, variations of the embodiments described herein are also contemplated by the invention.

Figure 10A:
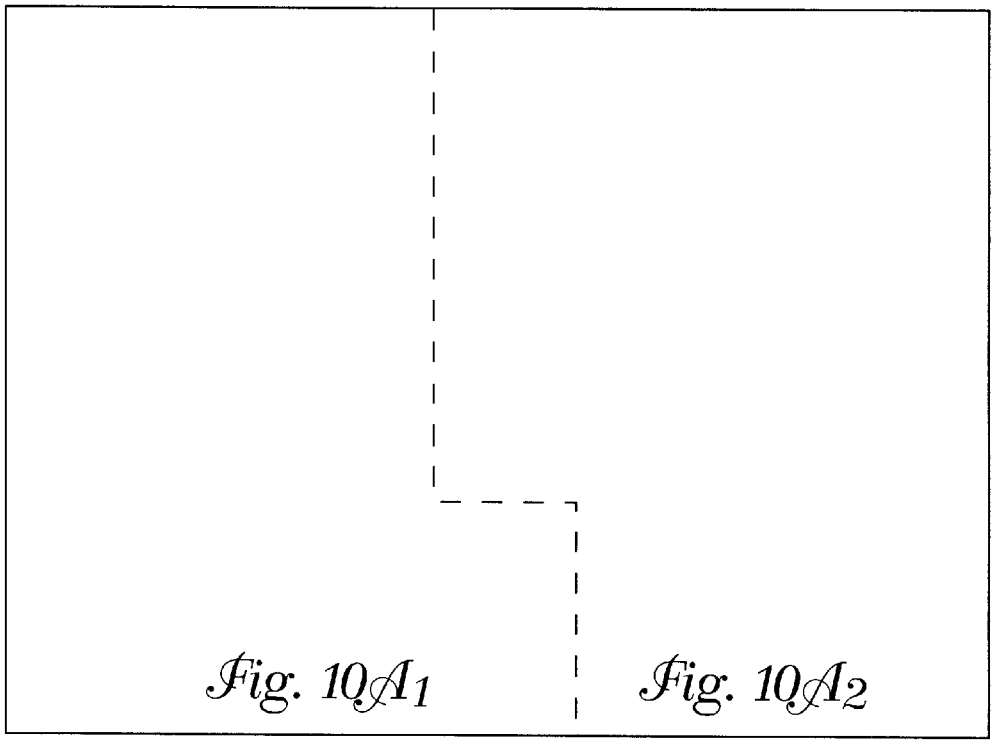
FIGS. 10A–10C illustrate an exemplary thrust limiting configuration in accordance with the principles of the present invention.
Figure 10B:
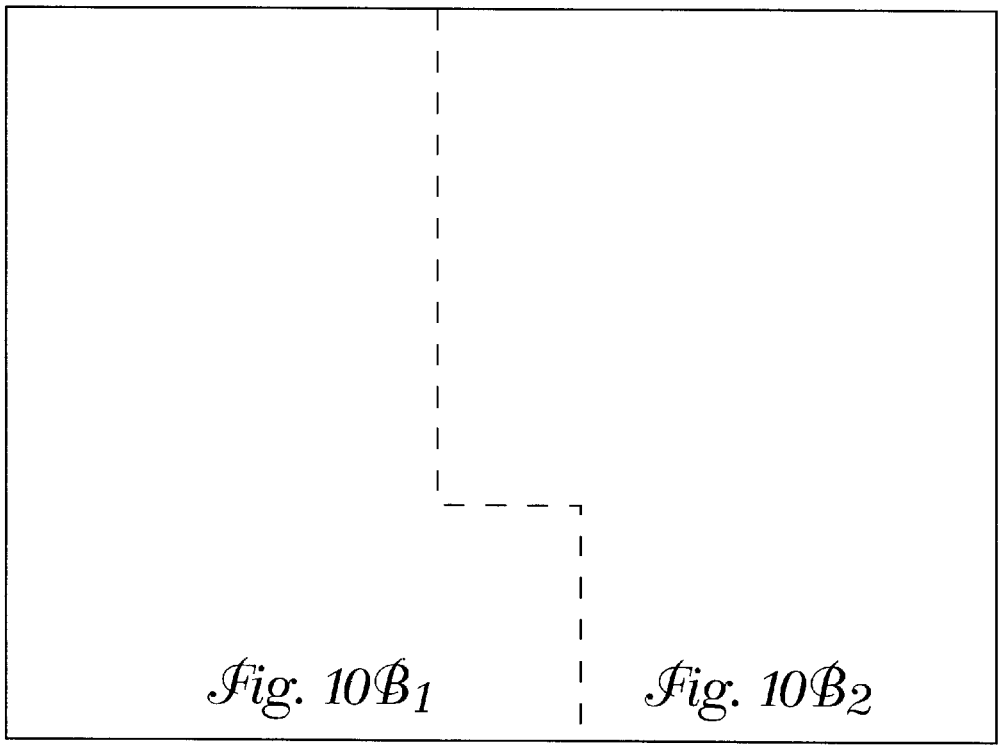
Figure 10C:
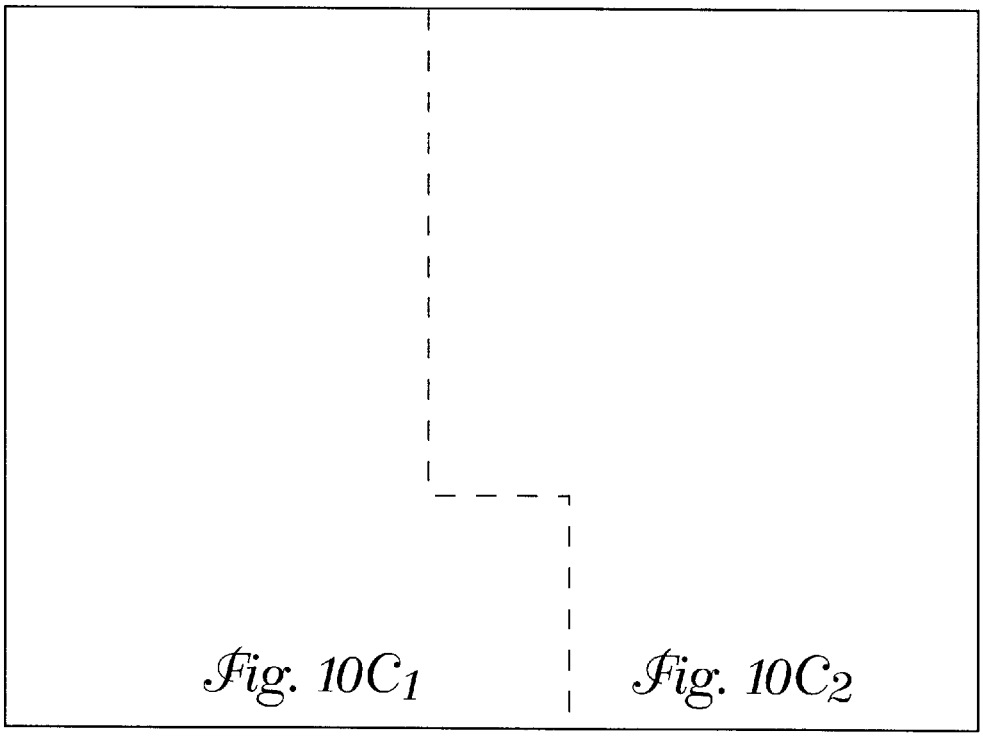

FIGS. 10A–10C illustrate an exemplary thrust limiting configuration 250 in accordance with the principles of the present invention. This particular thrust limiting configuration is described in terms of an underground boring apparatus that utilizes a hydraulic thrust mechanism. The thrust limiting configuration 100 includes a pump 252 that provides hydraulic pressure to rod gripping units 254 and 256 (used primarily to facilitate fastening and unfastening rods to the drill string), and also provides hydraulic pressure to the hydraulic cylinder 258 of the thrust mechanism, such as thrust mechanism 40 shown in FIG. 1. It will be appreciated that the pump 252 can be any type of conventional pump, such as a hydrostatic pump. A pump that has been determined to be suitable is sold as model no. 70423RDH by Eaton Manufacturing of Eden Prairie, Minn.

The pump 252 of FIGS. 10A–10C has a pressure output line 260 having a branch 262 that provides pressure to the gripping units 254, 256, and a branch 264 that provides pressure to the hydraulic cylinder 258. A three-position solenoid valve 266 controls the pressure provided to the hydraulic cylinder 258 through the pressure line 264. The solenoid 266 of FIG. 10A is in a middle position such that the solenoid valve 266 prevents pressure from reaching the cylinder 258. In FIGS. 1OB and 1OC, the solenoid valve 266 is shown moved to a position to the right, such that the valve causes pressure to be directed to a first port 270 of the cylinder 258 to cause the cylinder piston to extend. The solenoid 266 can also be oriented in a left position (not shown) where the solenoid directs pressure from the pump 252 to the second port 272 to retract the piston of the cylinder 258. When the piston is being retracted or extended, the valve 266 opens fluid communication between the cylinder 258 and a reservoir 274.

The pump 252 includes a port 276 for use in limiting the output pressure of the pump 252. When no pressure is applied to the port 276, the pump outputs a pressure substantially the same as a standby pressure (e.g., 400 psi) that is provided by a spring biased against solenoid 278. When a pressure is applied to the port 276, the pump outputs a pressure substantially equal to the sum of the standby pressure and the pressure applied to the port 276. Thus, if a 1400 psi pressure is applied to the port 276, the pump will output a pressure of 1800 psi.

The thrust limiting configuration 250 also includes a thrust limiter 280 positioned along a pressure line 282 that extends from the valve 266 to the port 276 of the pump 252. The pressure line 282 includes a first portion 282*a* positioned between the thrust limiter 280 and the port 276, and a second portion 282*b* positioned between the thrust limiter 280 and the valve 266. When the valve 266 is in either of the left or right positions, the pressure line 282 is in fluid communication with the pressure line 264 that provides pressure to the cylinder 258.

The pressure limiter 280 includes a solenoid valve 284 positioned in parallel with a pressure reducing valve 286. The solenoid valve 284 is moveable between an open position (shown in FIGS. 10A and 10B) and a closed position shown in FIG. 10C. When the valve 284 is open, the valve 284 allows the pressure applied to the cylinder 258 by the pump 252 to bypass the pressure reducing valve 286 and be applied directly to the port 276. Thus, with the valve 284 open, the pressure provided to the cylinder 258 can progressively increase until the pump 252 reaches its maximum pressure capacity (e.g., 3000 psi).

The thrust limiter 280 is activated by closing valve 284 as shown in FIG. 10C. With the valve 284 closed, pressure in the line 282 is routed through the pressure reducing valve 286. The pressure reducing valve 286 can be set to a desired pressure limit. Pressure will continue to be routed through the pressure reducing valve 286 until the pressure reaches the preset pressure limit. When the preset pressure limit is reached, pressure in line 282*a* causes the pressure reducing valve 286 to close such that pressure in the line 282*a* is prevented from increasing further. Thus, the pressure output by the pump 252 is limited to a value substantially equal to the standby pressure of valve 278 plus the pressure limit set by the pressure reducing valve 286. As long as the pressure in line 282*b* exceeds the pressure limit value set by the pressure reducing valve 286, the pressure reducing valve 286 will remain closed. However, if the pressure in line 282*b* falls below the pressure limit set by the pressure reducing valve 286, pressure within line 282*a* travels through the valve 284 to equalize the pressure. Thus, the pressure in line 282*a* will fall below the preset limit of the pressure reducing valve causing the pressure reducing valve to move to the open position. Pressure setting of valve 286 can be accomplished with a mechanical adjustment of a valve, or electronically using, for example, a pulse-width modulated valve.

The above-described configuration 250 allows for activation and deactivation of the thrust limiter 280 to account for the unsupported rod length of drill rods as the underground boring process occurs. For example, when the unsupported rod length is sufficiently short such that the thrust motor is incapable of producing a force to reach the yield point of the shortened rod, it may be desirable to deactivate the pressure limiter 280 such that a maximum pressure of the pump can be provided to the cylinder 258. By contrast, when the unsupported rod length is of sufficient length that the thrust motor can generate a force capable of reaching the yield point, the thrust limiting system can be activated such that the maximum pressure that can be provided to the cylinder 258 is limited to a value less than the maximum capacity of the pump. It will be appreciated that the activation/deactivation process can be carried out manually, or may be automated using an electronic controller. In the illustrated embodiments of FIGS. 10A–10C, the limited pressure would be substantially equal to the sum of the standby pressure of the pump 252 and the pressure limit value set at the pressure reducing valve 286.

Figure 11:
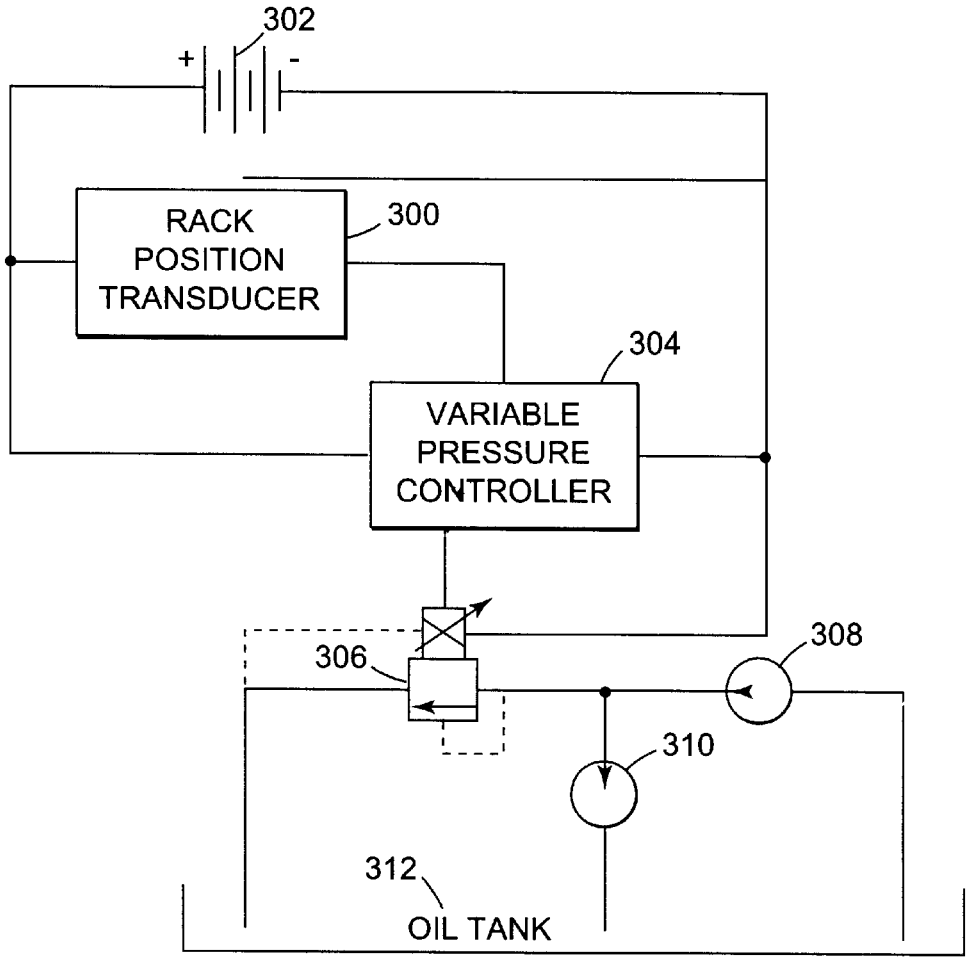
FIG. 11 illustrates another embodiment of a thrust limiting configuration in accordance with the present invention.

Referring now to FIG. 11, another embodiment of a thrust limiting configuration in accordance with the present invention is provided. A rack position transducer 300 is coupled across a voltage represented by the voltage source 302. Rack position transducers were previously described. The rack position transducer 300 is coupled to the variable pressure controller 304. The variable pressure controller 304 may take on a variety of forms, largely depending on the type of electrically variable relief valve 306 used in the system. For example, if the relief valve 306 receives a digital signal as it's input, then the variable pressure controller 304 may include an analog-to-digital converter (ADC) to convert the transducer 300 signal to a digital control signal for the relief valve 306. A pump 308 and motor 310 are arranged in a typical manner with respect to the oil tank 312 for hydraulic operation.

With this system, thrust is electrically varied depending on the position of the drill rod relative to the rack. This position is monitored via the rack position transducer 300, and in one embodiment, the signal generated by the position transducer 300 is converted by the variable pressure controller 304 to a pulse-width modulated (PWM) signal. The PWM signal is then used to change the setting of the electrically-variable relief valve 306.

As previously noted, there are various embodiments in which drill string characteristics may be monitored and measured in order to calculate the appropriate yield point, and throttle the thrust force in response. A representative example was provided above, where at least some of the relevant drill string characteristics correspond to the unsupported (or relatively low-support) portion of a drill rod as it is pushed into the ground during a drilling operation. Another representative example is provided below.

The following embodiment of the invention is directed to automatic limitation of drill string thrust force during an underground boring process, in order to ensure that segments of drill rods do not deform, collapse or become otherwise damaged by reaching the buckling or yield point of the rods. Another portion of the drill string at risk of deformation or buckling includes portions of the drill string that are being flexed during drilling such that the bend radius of the drill string, or a portion thereof, potentially reaches the yield point. The present invention contemplates monitoring the bend radius along the drill string, and knowing the maximum bend radius for a given drill rod and/or drill string segment, the buckling point can be calculated. The thrust force produced by a thrust source or motor is then limited such that it will not generate a thrust force capable of causing the drill rod or drill segment in question to reach the yield point. The drill string is advanced at the limited thrust value during the drilling operation, but the allowed thrust value will change as the measured bend radius at selected points along the drill string changes. In another embodiment, the torque force is also limited to prevent premature failure of the rod or drill segment, as the torque force applied also effects the stress on the drill string.

Figure 12:
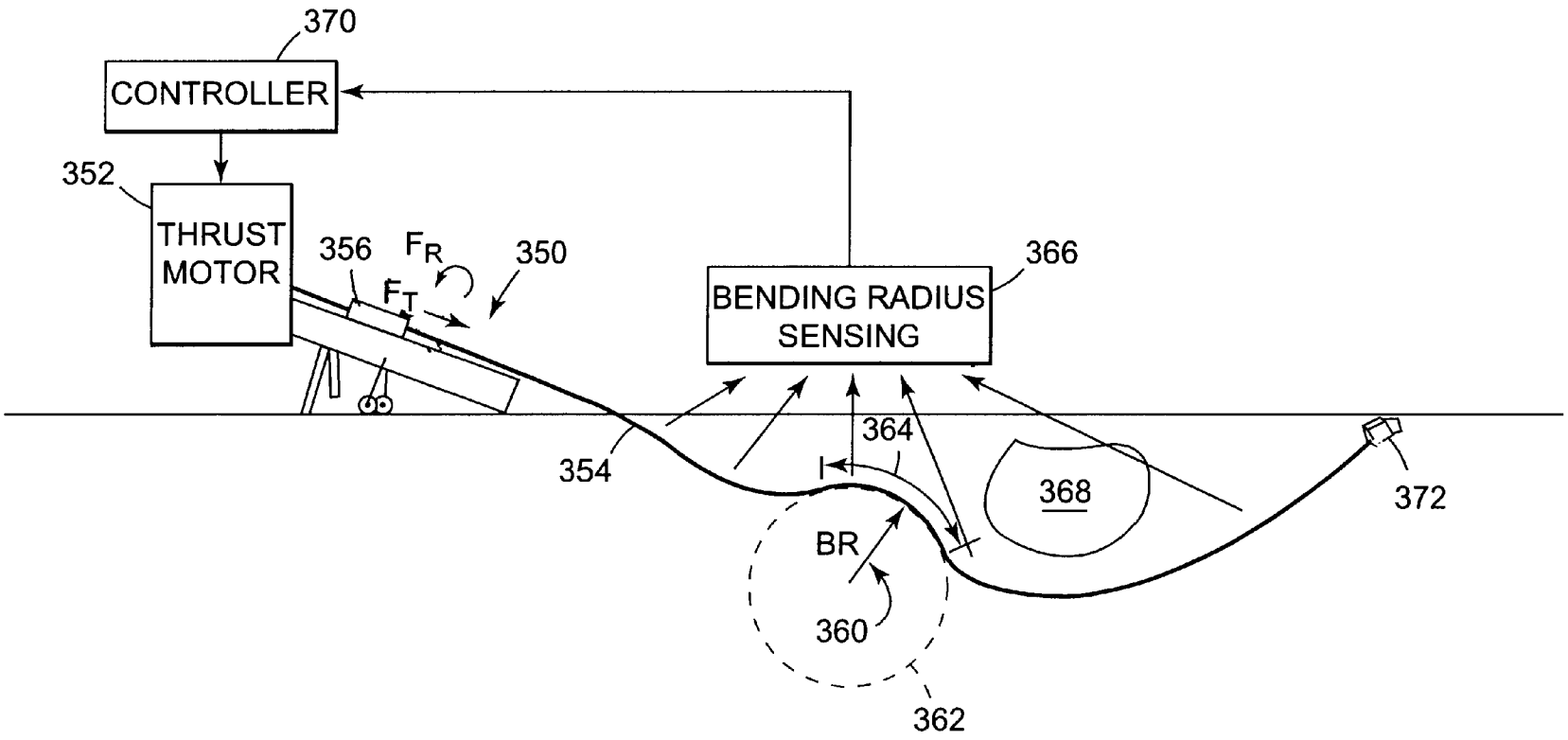
FIG. 12 is a block diagram of an exemplary system for limiting thrust force as a function of bend radius in accordance with the present invention.

FIG. 12 is a block diagram of an exemplary system for limiting thrust force as a function of bend radius, in accordance with the present invention. The underground boring machine 350 includes a thrust motor 352 that applies an axially directed force to the drill string 354 in a forward axial direction during the creation of a bore. The thrust motor 352 can controllably provide varying levels of controlled force when thrusting the drill string 354 into the ground to create a bore. The gear box 356 serves as the rotation pump driving a rotation motor and controllably provides varying levels of controlled rotation to the drill string 354 as it is thrust into the ground during a boring operation. An engine or motor (not shown) may provide power, typically in the form of pressure, to both the thrust motor 352 and the gear box 356, although each may be powered by separate engines or motors.

As indicated above, the thrust motor 352 provides varying levels of controlled force when advancing the drill string 354 through the contemporaneously-created bore. The axial thrust force generated by the thrust motor 352 is imparted to the gear box 356 coupled to the drill string 354. The gear box 356 thus imparts a thrust force, $F_T$, on the drill string 354 as it is pushed into the ground. Further, the gear box rotates the drill string 354 in response to a rotation pump, such as the rotational driver or pump 24 shown in FIG. 1.

In the embodiment illustrated in FIG. 12, the drill string characteristics being monitored includes the bend radius of all or a portion of the drill string 354. The bend radius BR 360, i.e., pitch change, of the drill string during boring indicates how sharply the drill string is being bent in response to intentional or unintentional steering of the drilling tool. The bend radius 360 represents the radius of an approximate arc or circle, such as circle 362, at a given segment of the drill string 354. The drill string segment 364 appears to exhibit a relatively short bend radius compared to other portions of the drill string 354, and the bend radius can be sensed by the bend radius sensing module 366. The bend radius may shorten for a variety of reasons, including being diverted off of a desired drill plan by subterranean structures (e.g., rocks), or due to the necessity of intentionally diverting from the current drill path to avoid an obstacle 368. In accordance with the present invention, monitoring the drill string bend radius provides information as to how sharp of a turn the drill string is making at a particular point. This segment along the drill string path may be more susceptible to exceeding the elastic limit of the rods comprising the drill string, as the drill path bend has already caused one or more rods at that segment 364 to exhibit an appreciable bend. Depending on the degree of bending being subjected to the drill rods, which is determined by ascertaining the bend radius of the drill string segment 364, the thrust can be adjusted to reduce the possibility of reaching the buckle point of the drill string segment 364. For example, if a segment 364 of the drill string 354 exhibits a bend radius of seventy-five feet, this information can be fed back to the controller 370. The controller 370 determines how much the thrust force should be reduced in view of the bend radius, and provides control signals to the thrust motor 352 to reduce the thrust force $F_T$. Therefore, the thrust limitation process is automatic, and requires no operator input. Alternatively, if the operator or control program is dissatisfied with the amount of thrust force allowed by the controller 370, the operator or programmed drill plan can decide to pull the drill string back far enough to bore a new drill path around the obstacle 368 that has a greater bend radius.

Because the drill path is governed by the direction taken at the distal end 372 of the drill string 354 with respect to the drilling machine, the bend radius along the drill path can be plotted by monitoring the path taken by the leading edge 372 of the drill string. A variety of manners of sensing the bend radius of the drill string along the drill path are discussed below.

Figure 13:
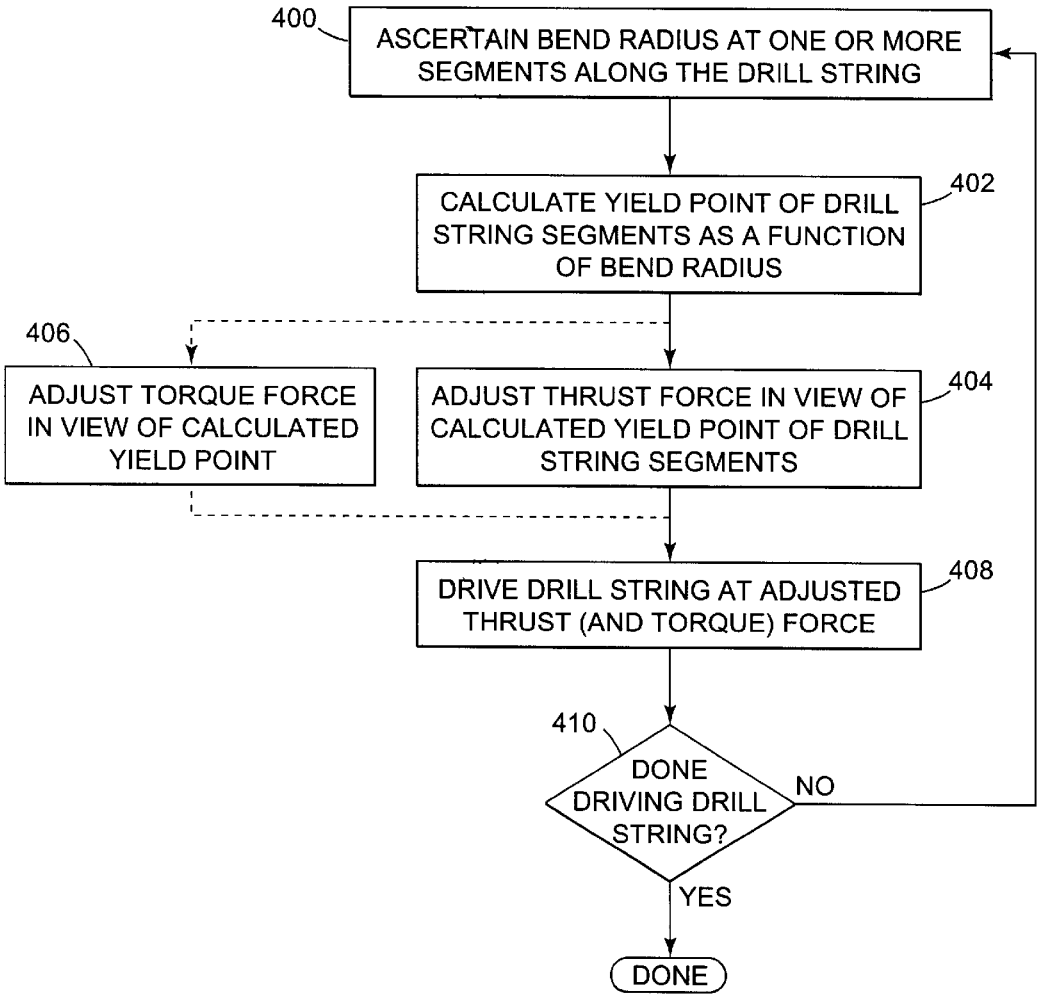
FIG. 13 is a flow diagram of a method for controllably limiting thrust in accordance with the principles of the present invention.

FIG. 13 is a flow diagram of a method for controllably limiting thrust in accordance with the principles of the present invention. In the illustrated embodiment of FIG. 13, the bend radius of the drill string being driven into the ground, or of at least one segment along the drill string, is ascertained 400 at a given time. As discussed above, the bend radius is a dimension that identifies the severity of a bend in the drill string. The bend radius is therefore dependent on the particular path taken by the drill string as it is advanced through the bore. The bend radius may be determined in a manner as described herein, or in any other manner known in the art to determine the bend radius of a drill string associated with an underground drilling mechanism.

The yield point of the drill string or segments is calculated 402 as a function of the bend radius information ascertained at block 400. As previously described, a drill string may be subject to buckling where, for example, a relatively sharp turn in the drill path is required or otherwise occurred during drilling. In this case, the non-axial vector force is a force that deviates from the axial direction of the drill string, and may cause buckling of the drill string if the elastic limit of any of the drill rods is exceeded. Depending on the ascertained bend radius information, the corresponding yield point may be calculated 402.

Having determined the yield point of the drill string as a function of bend radius, the thrust force is adjusted 404 in view of the now known yield point of the drill string segment(s). Where the bend radius data reveals a relatively straight drill path, the thrust may be adjusted 404 upwards, i.e., increased, to optimize drilling efficiency. Where the bend radius data reveals one or more drill string segments having a relatively short bend radius, the thrust may be adjusted 404 downwards, i.e., decreased. Whether the thrust is actually increased or decreased depends on the thresholds set, as well as the current thrust force value.

Optionally, the torque force may also be adjusted 406 in view of the calculated yield point. The combined loading of the drill rod will generally be a function of the bend radius, the thrust load and the torque load. To avoid damage to the drill rods, this combined loading should be limited to a maximum yield point. The control system can be developed to allow automatic limitation of either the thrust load or the torque load. For example, if the ascertained bend radius data indicates that it may be nearing the calculated yield point of one or more drill string segments, the thrust force, or the thrust force and the torque force may be reduced to reduce the risk of drill rod damage. In either case, the drill string is driven 408 at the adjusted thrust force, and optionally at the adjusted torque force.

Until the boring process is complete as determined at decision operation 410, bend radius monitoring and thrust control continues. This continual monitoring may be performed on a periodic time basis, a periodic drill advancement distance, or other predetermined criteria. A wide variety of other manners for effecting continuous, periodic, random, interrupt-driven, or other repeated monitoring of the bend radius may be used in connection with the present invention. In accordance with one embodiment of the invention, the bend radius is repeatedly measured at a rate dictated by the circuitry sensing the location of the drill string. The resulting, updated bend radius measurements are stored in a memory device for subsequent utilization in the yield point calculation. Therefore, while the feedback path from decision block 410 to block 400 is meant to illustrate the use of multiple readings in connection with this embodiment of the invention, the bend radius readings need not be performed in the serial nature represented by the example of FIG. 13. Instead, bend radius readings may be taken at any desired periodicity (whether synchronous or asynchronous), and the rate of change of the actual, limited thrust force may be as often as necessary to maintain the desired thrust level. For example, the actual thrust applied to the drill string may be updated every three seconds, or may be updated every tenth of a second. In either case, the thrust limiting feature of the present invention is utilized. However, the more often the bend radius is updated, the more precise and uniform the resulting applied thrust.

The thrust limiting systems described herein are applicable to the thrust limiting embodiment based on the drill string bend radius. For example, the thrust limiting system described in connection with FIG. 8 may be used to adjust the thrust force in response to bend radius information. Referring briefly to FIG. 8, the illustrated thrust limiting system can be modified such that the processor 144 receives bend radius information from a bend radius sensing module rather than from the rod length sensing module 148. Further, the rod parameters 146 would include information pertaining to the known yield point or elastic limit of the rods that comprise the drill string. Such information is generally provided by the drill rod manufacturer, or otherwise may be determined through empirical testing.

When used to limit thrust based on the drill string bend radius, the processing module 144 of FIG. 8 provides an allowable maximum thrust value to the thrust limiting module 142. The processor 144 determines the allowable maximum thrust as a function of various rod parameters 146 and the bend radius sensed by a bend radius sensing module, some examples of which are described below. As described earlier, other the rod parameters may include the material properties of the drill rod, rod dimensions, etc. Based on a buckle formula programmed into the processor 144, the thrust force may be limited such that it will not reach or exceed the buckle force (yield point) of the drill string.

In the example embodiment of FIG. 8, a rod length sensing module 148 would be replaced, or supplemented, with a bend radius sensing module (not shown). The bend radius of the drill string or a portion thereof may be determined in the manner described herein, and in accordance with other bend radius measuring devices. For example, a bend radius sensing module may include a locator or tracker unit. A tracker unit may be employed to receive an information signal transmitted from a boring tool affixed to the drill string, such as at the distal end 372 of the drill string 354 of FIG. 12. The boring tool generally includes a mechanism for cutting through the subterranean structure, and may include other mechanisms such as a steering mechanism. The boring tool may also include a transmitter to transmit an information signal to the tracker unit to provide an indication of it's underground location. The tracking unit in turn communicates a location signal corresponding to the whereabouts of the boring tool (i.e., one end of the drill string) to a receiver situated at the boring machine. Thus, the mobile tracker unit may be used to track and locate the progress of the boring tool which is equipped with a transmitter that generates a sonde signal. For example, the sonde at the end of the drill string may be detected/located each time a new drill rod is loaded onto the drilling apparatus to extend the drill string. Alternatively, readings may be taken at any desired time interval or distance traveled. By tracking the boring tool at the end of the drill string, the drill path, and thus the drill string that follows the drill path, can be plotted, and the bend radius can be calculated.

Locating and/or plotting a drill path using a locator or tracking unit may be determined as described herein, and according to other known locator techniques such as those disclosed in U.S. Pat. Nos. 5,767,678; 5,764,062; 5,698,981; 5,633,589; 5,585,726; 5,469,155; 5,337,002; and 4,907,658, all of which are hereby incorporated herein by reference in their respective entireties.

Another manner of determining the bend radius in accordance with the invention is to establish a drill plan having a known bend radius, and adjust the thrust according to the anticipated bend radius of the drill plan. This embodiment essentially allows for boring operations to be conducted, and automatic thrust limiting in accordance with the present invention, without directly monitoring the actual bend radius of the drill string. Instead, the bend radius used is based on an assumption that the actual bend radius will parallel the bend radius of the pre-programmed drill plan. Establishing a drill plan may be determined in a manner described herein, and according to other known drill plan techniques such as disclosed in U.S. patent application Ser. No. 09/482,288 entitled "Automated Bore Planning Method and Apparatus For Horizontal Directional Drilling," filed on Jan. 13, 2000, which is assigned to the assignee of the instant application, the content of which is incorporated herein by reference in its entirety.

In yet another embodiment, strain gauges can be used on some or all of the drill rods. A signal representative of the strain exerted on the rod is derived from the strain gauge, and can be provided to the controller in a number of ways. For example, the strain signal may be transmitted through the drill string itself to the sonde at the leading end of the drill string from where it can be transmitted to, for example, a locator unit above the surface of the ground. In another example, the strain signal may be transmitted back to the drilling machine where it is received and provided to the controller. Transmission of signals through the drill string may be determined in a manner described herein, and according to other known techniques such as disclosed in U.S. patent application Ser. No. 09/405,889 entitled "Real-Time Control System And Method For Controlling An Underground Boring Machine," filed Sep. 24, 1999, which is assigned to the assignee of the instant application, the content of which is incorporated herein by reference in its entirety.

Further, an operator may manually compute an estimated bend radius by estimating the path required by the drill string. For example, due to known underground obstructions, the operator may determine that a sharp bend in the drill path will be required to avoid a particular obstruction. Manual calculation (including with the aid of computing devices) of a bend radius can be performed, with the resulting bend radius entered for use by the controller to determine the amount of thrust limiting to employ.

Other means of locating the drill string, and thus determining the actual drill path taken, include manners of sensing the underground drill string itself. For example, ground-penetrating radar (GPR) techniques may be used to locate the drill string and determine the bend radius in response thereto. It should be recognized that the present invention is applicable in a system employing any type of technology to sense the position, and therefore the bend radius, of the underground drill string.

Figure 14:
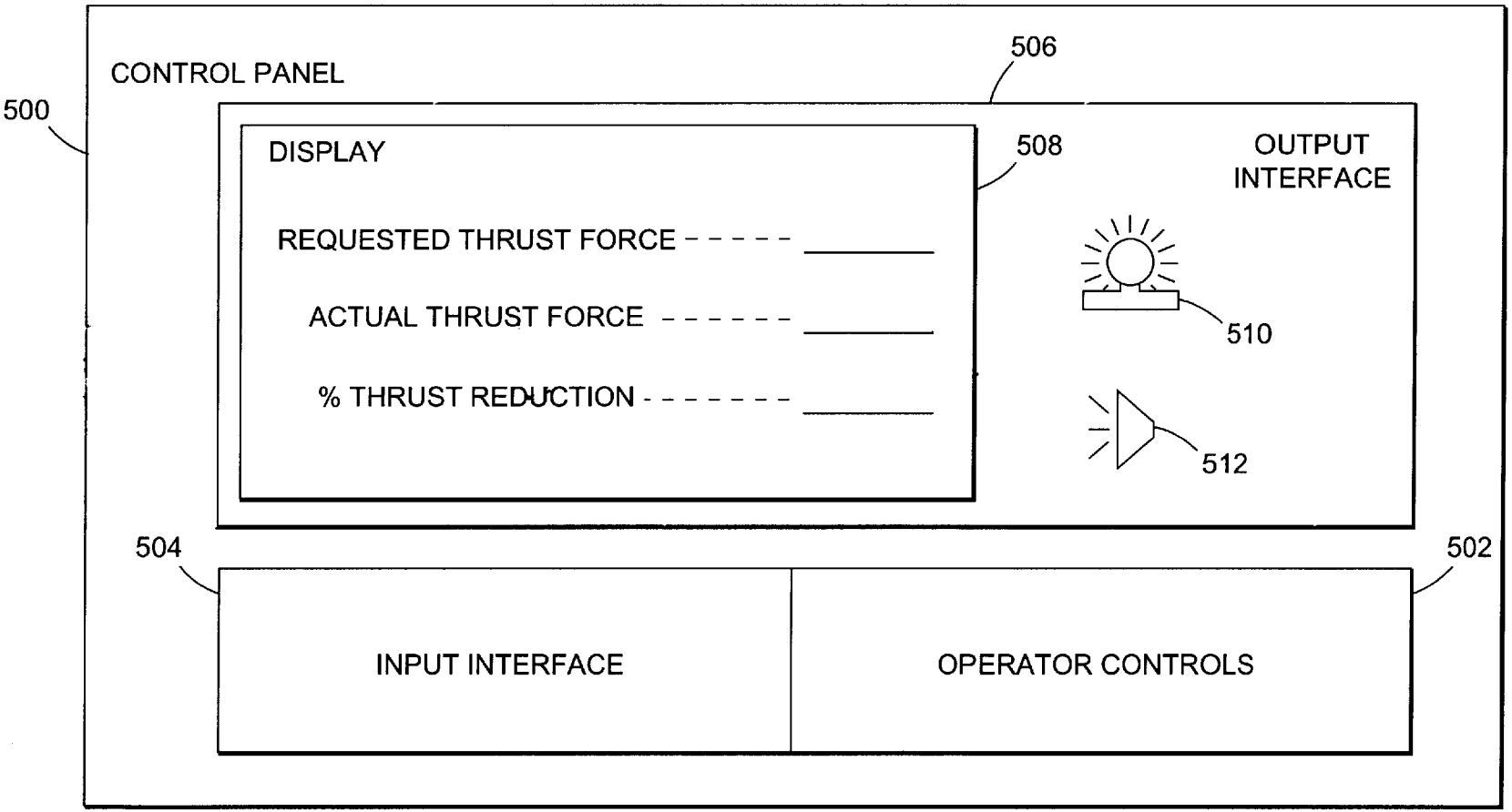
FIG. 14 is a diagram illustrating an example control panel 500 available to an operator of the underground boring machine.

As previously described, a control panel may be provided as an operator interface to the boring apparatus. FIG. 14 is a diagram illustrating an example control panel 500 available to an operator of the underground boring machine. The control panel 500 may be used in connection with an underground boring machine as was illustrated by the control panel 78 of FIG. 4. The control panel 500 is preferably mounted on the underground boring machine, and includes a number of manually actuatable switches, knobs, levers, keyboard entry, keypad, touch-sensitive screen or other user input devices. These operator inputs are generally identified as the operator controls 502, and are used to provide the operator an interface to manually control the thrust motor and other components of the boring machine, as well as the automatic thrust limiting system of the HDD machine. The input interface 504 represents other inputs to the system, such as control or other signals to the underground boring apparatus.

The output interface 506 may include a display 508, indicator lights 510 and other visual indicators, audio outputs 512, and other outputs. The output interface 506 provides, among many other types of information associated with operation of the boring machine, an indication to the operator or system if and when the thrust is being limited due to a risk of reaching the buckling point of a rod such as the thrust limit notification 156 shown in FIG. 8.

Notification to the operator of the system being subject to automatic thrust limiting allows the operator to make adjustments in drilling, and to become more skilled as an operator. Various conditions may exist in which thrust limiting may or may not be applied. For example, if the operator is not requesting a thrust force large enough to reach the buckle force of the unsupported portion of the drill rod, the thrust force need not be limited. Further, the unsupported rod length may reach a length small enough such that no thrust force capable of being generated by the particular thrust motor can buckle the rod. By notifying the operator when the thrust is being limited, it also allows the operator to become more skilled and efficient in applying the appropriate thrust force during the underground boring process.

As shown on the example output interface 506 in FIG. 14, such notification can be provided to the operator in one or more of a variety of output mechanisms. For example, the indicator light 510 may be illuminated and/or an audible signal or voice provided by the audio output 512, and further providing text and/or graphic images on the display 508 to identify, among other things, the requested thrust force, the actual thrust force applied after thrust limiting is imposed, and the percentage or absolute value of the thrust limiting.

As will be readily appreciated by those skilled in the art, other manners of notifying the operator may be utilized in accordance with the invention. Furthermore, such notifications and information may be stored in a memory for future reference, troubleshooting, and the like. The information can be transmitted from the control panel 500 to a portable receiving unit (not shown) used by the operator, or to a remote location. Transmission of this information to a remote location may be carried out via known data transmission methods, including transmission via modem or via the Internet. By collecting, storing and/or transmitting the information, the information may be used for statistical analysis, remote troubleshooting, debugging, training, and the like.

The foregoing description of the exemplary embodiment of the invention has been presented for the purposes of illustration and description. It is not intended to be exhaustive or to limit the invention to the precise form disclosed. Many modifications and variations are possible in light of the above teaching. For example, while the description provided herein generally refers to "thrust" forces, it should be recognized, and will be so recognized by those skilled in the art, that thrust forces may advance the drill string when the thrust force is positive, and pull back the drill string when the thrust forces are negative. In other words, a positive thrust force will drive or otherwise advance the drill string into the ground, while a negative or "reverse" thrust force (i.e., pullback force) will pull the drill string back through the subterranean bore. During pullback procedures, the drill string will be subject to tension, rather than compression in the case of forward thrusting. In some instances, the drill string characteristics being sensed may indicate a bend radius or other characteristic that would require adjustment of the pullback force using the principles described herein. Thus, it is intended that the scope of the invention be limited not with the particular representative embodiments set forth in this detailed description, but rather by the claims appended hereto.

What is claimed is:

1. A method for controlling the underground transit of a drill string, comprising:

determining one or more drill string characteristics influencing a yield point of at least a portion of the drill string;

computing the yield point of the drill string portion as a function of the one or more drill string characteristics; and adjusting a thrust force imparted to the drill string in response to the computed yield point.

2. The method of claim 1, wherein determining the drill string characteristics comprises repeatedly determining the drill string characteristics and computing the yield point, such that the thrust force is repeatedly adjusted.

3. The method of claim 1, wherein determining one or more drill string characteristics comprises measuring an unsupported length of the drill string.

4. The method of claim 3, wherein measuring an unsupported length of the drill string comprises measuring a length of the drill string approximately between a coupling region at the proximal end of the drill string, and a predetermined point proximate the ground.

5. The method of claim 1, wherein determining one or more drill string characteristics comprises measuring a length of the drill string having low radial compression applied thereto, wherein the low radial compression is such that the length of drill string is capable of bending.

6. The method of claim 1, wherein determining one or more drill string characteristics comprises ascertaining the bend radius of at least one portion of the drill string.

7. The method of claim 1, wherein determining one or more drill string characteristics comprises ascertaining a minimum bend radius occurring along the drill string, wherein the minimum bend radius corresponds to a maximum bend along the drill string.

8. The method of claim 1, further comprising overriding adjusting the thrust force in response to an override signal.

9. The method of claim 1, further comprising eliminating adjustments to the thrust force if a current thrust force is within a predetermined optimal operating range.

10. The method of claim 1, wherein adjusting the thrust force comprises limiting the thrust force to an allowable thrust force that is less than a force corresponding to the computed yield point.

11. The method of claim 1, wherein adjusting the thrust force comprises increasing the thrust force if the thrust force imparted to the drill string is less than the computed yield point by at least a predefined amount.

12. The method of claim 1, wherein adjusting the thrust force comprises decreasing the thrust force if the thrust force imparted to the drill string is within a predefined range of a force corresponding to the computed yield point.

13. The method of claim 1, further comprising moving the drill string along an underground path in accordance with the adjusted thrust force.

14. The method of claim 1, wherein determining the drill string characteristics comprises sensing dimensional attributes of the drill string.

15. The method of claim 1, wherein the drill string portion comprises between one and all drill rods forming the drill string.

16. The method of claim 1, further comprising providing a notification of when the thrust force is being adjusted.

17. A method for controlling the subterranean advancement of one or more drill rods forming a drill string, comprising:

measuring an unsupported length of the drill string;

calculating the yield point of the drill string portion as a function of the unsupported length of the drill string; and limiting a thrust force imparted to the drill string to a maximum allowable thrust force such that the yield point will not be reached.

18. The method of claim 17, further comprising overriding limiting the thrust force in response to an override signal.

19. The method of claim 17, wherein limiting the thrust force comprises reducing the thrust force such that the yield point is not reached.

20. The method of claim 17, wherein limiting the thrust force comprises maintaining the thrust force at a thrust level below a force corresponding to the yield point.

21. The method of claim 17, wherein calculating the yield point comprises determining a threshold thrust force that will cause buckling of the drill string based at least in part on the measured unsupported length of the drill string.

22. The method of claim 17, wherein measuring an unsupported length of the drill string comprises measuring a length of the drill string approximately between a coupling region at the proximal end of the drill string and ground level.

23. The method of claim 17, wherein measuring an unsupported length of the drill string comprises measuring an approximate length of the drill string between a coupling region at the proximal end of the drill string and a predetermined subsurface level.

24. The method of claim 23, wherein the predetermined subsurface level is an approximate distance below a ground surface having sufficient structural support to prevent bending of the drill string at the predetermined subsurface level.

25. The method of claim 17, wherein measuring the unsupported length of drill string comprises measuring the movement of a thrust mechanism that advances the drill string with a position transducer, and computing the unsupported length of drill string based on the distance traveled by the thrust mechanism.

26. The method of claim 17, wherein measuring the unsupported length of drill string comprises measuring the movement of a thrust mechanism that advances the drill string with a plurality of position sensors along the path of the thrust mechanism, and computing the unsupported length of drill string based on the distance traveled by the thrust mechanism.

27. The method of claim 17, wherein measuring the unsupported length of drill string comprises steps for determining the unsupported length of the drill string.

28. A method for controlling the movement of a drill string;

moving the drill string along an underground path;

determining a bend radius of at least a portion of the drill string along the underground path;

computing the yield point of the drill string portion as a function of the bend radius; and adjusting a thrust force imparted to the drill string in response to the computed yield point.

29. The method of claim 28, wherein adjusting the thrust force comprises reducing the thrust force such that the yield point is not reached.

30. The method of claim 28, wherein adjusting the thrust force comprises capping the thrust force to a maximum thrust force such that the yield point is not reached.

31. The method of claim 28, wherein adjusting the thrust force comprises increasing the thrust force to increase drilling performance, while ensuring that the yield point is not reached.

32. The method of claim 28, wherein adjusting the thrust force comprises increasing the thrust force as the bend radius increases, whereby the thrust force increases as the drill path tends to become more straight.

33. The method of claim 28, wherein adjusting the thrust force comprises decreasing the thrust force as the bend radius decreases, whereby the thrust force decreases as the drill path tends to become less straight.

34. The method of claim 28, wherein calculating the yield point comprises determining a threshold thrust force that will cause buckling of the drill string based at least in part on the bend radius of the drill string portion.

35. The method of claim 28, wherein determining the bend radius comprises calculating the bend radius from a pre-programmed drill path.

36. The method of claim 28, wherein determining the bend radius comprises transmitting position signals from a sonde attached to the drill string, receiving the position signals at a locator above ground, and ascertaining the bend radius from a drill path derived from the position signals.

37. The method of claim 28, wherein determining the bend radius comprises:

steps for ascertaining a drill path taken by the drill string; and steps for calculating the bend radius from the drill path.

38. The method of claim 28, wherein determining the bend radius comprises using ground penetrating radar (GPR) to locate the drill string underground.

39. A system for controlling the underground transit of a drill string, comprising:

a thrust engine to generate a thrust force for advancing the drill string;

at least one drill string sensor to sense one or more drill string characteristics impacting a yield point of at least a portion of the drill string;

a controller, coupled to the at least one drill string sensor and to the thrust engine, to calculate the yield point of the drill string portion as a function of the one or more drill string characteristics, and to generate a thrust force adjustment signal based on the calculated yield point; and wherein the magnitude of the thrust force is dependent on the thrust force adjustment signal.

40. The system of claim 39, further comprising a moveable thrust mechanism coupled to the thrust engine and to the drill string, wherein the thrust engine imparts the thrust force to the thrust mechanism causing the thrust mechanism to move, and wherein the thrust mechanism imparts motion to the drill string in response thereto.

41. The system of claim 39, further comprising a sonde coupled proximate a distal end of the drill string, wherein the sonde transmits position signals indicative of an underground position of the sonde.

42. The system of claim 41, wherein the drill string sensor comprises a locator unit situated above ground to sense the position signals transmitted by the sonde.

43. The system of claim 42, wherein the location unit repeatedly senses the position signals transmitted by the sonde to plot a drill path taken by the drill string portion.

44. The system of claim 43, wherein the controller further determines a bend radius of the drill string portion from the plotted drill path, and wherein the controller calculates the yield point as a function of a bend radius of the drill string portion.

45. The system of claim 39, wherein the drill string sensor comprises means for determining an unsupported length of one or more drill rods forming the drill string.

46. The system of claim 39, wherein the drill string sensor comprises means for determining a bend radius of the drill string portion.

47. The system of claim 39, wherein the drill string sensor comprises a displacement measuring unit to determine an unsupported length of one or more drill rods forming the drill string.

48. The system of claim 39, wherein the drill string sensor comprises a plurality of strain gauges coupled on selected ones of drill rods forming the drill string.

49. The system of claim 39, wherein the thrust force adjustment signal generated by the controller directs the magnitude of the thrust force to increase when the thrust force imparted to the drill string is less than the calculated yield point by at least a predetermined amount.

50. The system of claim 39, wherein the thrust force adjustment signal generated by the controller directs the magnitude of the thrust force to decrease when the thrust force imparted to the drill string is within a predetermined range of the calculated yield point.

51. An apparatus for controlling the underground transit of a drill string, comprising:

means for determining one or more drill string characteristics influencing a yield point of at least a portion of the drill string;

means for computing the yield point of the drill string portion as a function of the one or more drill string characteristics; and means for adjusting a thrust force imparted to the drill string in response to the computed yield point.

52. The apparatus as in claim 51, further comprising means for notifying an operator that the thrust force is being adjusted.

53. A horizontal drilling machine for directionally drilling a drill string into the ground, the drill string including a plurality of elongated members threaded together in an end-to-end relationship, the drilling machine comprising:

a track;

a rotational driver for rotating the drill string in forward and reverse directions about a longitudinal axis of the drill string;

a thrust mechanism for propelling the rotational driver along the track; and a thrust limiter that prevents the thrust mechanism from applying a thrust load to the drill string that exceeds a thrust load limit established at least in part by a buckle point of at least one drill string portion, wherein the thrust load limit is less than a maximum thrust load that can otherwise be generated by the thrust mechanism.

54. The horizontal drilling machine as in claim 53, wherein the thrust limiter comprises means for establishing the buckle point of the drill string portion.

* * * * *